US012031386B2

(12) United States Patent
Song et al.

(10) Patent No.: US 12,031,386 B2
(45) Date of Patent: Jul. 9, 2024

(54) BLADE COVER

(71) Applicant: Schlumberger Technology Corporation, Sugar Land, TX (US)

(72) Inventors: Huimin Song, Spring, TX (US); Youhe Zhang, Spring, TX (US); Sudarsanam Chellappa, Houston, TX (US); Ting Ren, Conroe, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/043,143

(22) PCT Filed: Aug. 26, 2021

(86) PCT No.: PCT/US2021/047731
§ 371 (c)(1),
(2) Date: Feb. 27, 2023

(87) PCT Pub. No.: WO2022/047017
PCT Pub. Date: Mar. 3, 2022

(65) Prior Publication Data

US 2024/0011358 A1 Jan. 11, 2024

Related U.S. Application Data

(60) Provisional application No. 63/071,188, filed on Aug. 27, 2020.

(51) Int. Cl.
*E21B 12/04* (2006.01)

(52) U.S. Cl.
CPC ..... *E21B 12/04* (2013.01)

(58) Field of Classification Search
CPC ..... E21B 12/04
See application file for complete search history.

(56) References Cited

U.S. PATENT DOCUMENTS 904,796 A * 11/1908 Moore ..... B27F 5/10 408/30
1,816,568 A * 7/1931 Carlson ..... E21B 10/003 175/401

(Continued)

FOREIGN PATENT DOCUMENTS

EP 3187285 A1 7/2017
WO 2012071449 A2 5/2012

(Continued)

OTHER PUBLICATIONS

International Preliminary Report on Patentability issued in International Patent application PCT/US2021047731 on Mar. 9, 2023, 7 pages.

(Continued)

*Primary Examiner* — Taras P Bemko
(74) *Attorney, Agent, or Firm* — Jeffrey D. Frantz

(57) ABSTRACT

A blade on a downhole drilling tool includes a blade body and a blade cover. The blade cover is pre-sintered and conforming to the blade outer shape. The blade cover is attached to the blade body. The blade cover includes a seamless connection between a cover leading face and a cover outer face to reduce wear on the outer face of the blade.

18 Claims, 18 Drawing Sheets

(56) References Cited

U.S. PATENT DOCUMENTS 2,079,417 A * 5/1937 Markley ..... E21B 21/015 175/209
2,255,435 A 9/1941 Newton
2,693,938 A 11/1954 Roberts
3,127,945 A 4/1964 Bridwell
4,367,904 A * 1/1983 Olschewski ..... E21B 10/20 175/372
4,445,580 A 5/1984 Sahley
4,521,664 A * 6/1985 Miller ..... B23K 9/04 219/76.14
4,646,857 A 3/1987 Thompson
4,682,663 A 7/1987 Daly
4,830,123 A 5/1989 Daly
4,838,366 A 6/1989 Jones
5,452,771 A 9/1995 Blackman et al.
5,560,440 A 10/1996 Tibbitts
6,209,420 B1 4/2001 Butcher
6,241,036 B1 6/2001 Lovato
6,260,636 B1 7/2001 Cooley
6,454,030 B1 9/2002 Findley
6,458,471 B2 10/2002 Lovato
6,568,491 B1 5/2003 Matthews, III
6,651,756 B1 11/2003 Costo, Jr.
6,655,481 B2 12/2003 Findley
6,742,611 B1 6/2004 Illerhaus
6,746,506 B2 6/2004 Liu
7,070,011 B2 7/2006 Sherwood, Jr.
7,070,734 B2 7/2006 Liu
7,096,982 B2 8/2006 McKay
7,571,782 B2 8/2009 Hall et al.
7,597,159 B2 10/2009 Overstreet
7,644,786 B2 1/2010 Lockstedt
7,703,555 B2 4/2010 Overstreet
7,703,559 B2 4/2010 Shen
7,722,802 B2 5/2010 Pfeifer
7,784,567 B2 8/2010 Choe et al.
7,814,997 B2 10/2010 Aliko
7,819,208 B2 10/2010 Pessier
7,832,456 B2 11/2010 Calnan
7,832,457 B2 11/2010 Calnan
7,954,569 B2 6/2011 Mirchandani
8,002,052 B2 8/2011 Stevens
8,007,714 B2 8/2011 Mirchandani
8,087,324 B2 1/2012 Eason
8,091,655 B2 1/2012 Shen
8,172,914 B2 5/2012 Mirchandani
8,201,610 B2 6/2012 Stevens
8,201,647 B2 6/2012 Zulak
8,230,952 B2 7/2012 Schwefe
8,235,149 B2 8/2012 Lockstedt
8,272,458 B2 9/2012 Nackerud
8,312,941 B2 11/2012 Mirchandani et al.
8,317,893 B2 11/2012 Stevens
8,388,723 B2 3/2013 Overstreet
8,403,080 B2 3/2013 Mirchandani
8,413,746 B2 4/2013 Shen
8,459,382 B2 6/2013 Aliko et al.
8,464,814 B2 6/2013 Stevens
8,567,531 B2 10/2013 Belnap et al.
8,720,610 B2 5/2014 Lanning
8,757,297 B2 6/2014 Aliko et al.
8,758,462 B2 6/2014 Overstreet
8,789,625 B2 7/2014 Mirchandani et al.
8,800,691 B2 8/2014 Shen
8,814,968 B2 8/2014 Jiang
8,869,920 B2 10/2014 Stevens
8,881,791 B2 11/2014 Eason
8,960,332 B2 2/2015 Ugwuocha
8,991,523 B2 3/2015 Shen et al.
9,033,070 B2 5/2015 Shen
9,068,408 B2 6/2015 Vempati et al.
9,115,554 B2 8/2015 Vempati
9,200,485 B2 12/2015 Eason
9,393,674 B2 7/2016 Keshavan
9,482,058 B2 11/2016 Siracki
9,488,012 B2 11/2016 Thigpen
9,506,297 B2 11/2016 Overstreet
9,579,717 B2 2/2017 Vempati et al.
9,790,744 B2 10/2017 Atkins
9,869,130 B2 1/2018 Rose
9,869,132 B2 1/2018 Wyble
9,890,595 B2 2/2018 Oxford
9,937,589 B2 4/2018 Soshi
9,982,490 B2 5/2018 Fuller
10,024,108 B2 7/2018 Gylling
10,029,301 B2 7/2018 Cook, III et al.
10,029,305 B2 7/2018 Cook, III
10,029,306 B2 7/2018 Voglewede
10,059,092 B2 8/2018 Welch
10,077,638 B2 9/2018 Overstreet
10,082,024 B2 9/2018 Raschka
10,107,044 B2 10/2018 Vempati
10,125,549 B2 11/2018 Olsen
RE47,369 E 4/2019 Shen
10,267,095 B2 4/2019 Keshavan
10,386,801 B2 8/2019 Oxford
2005/0211475 A1 9/2005 Mirchandani
2007/0056777 A1 3/2007 Overstreet
2008/0314645 A1 12/2008 Hall
2009/0107730 A1 4/2009 Green
2009/0301788 A1 12/2009 Stevens
2010/0101866 A1 4/2010 Bird
2010/0108401 A1 5/2010 Lanning
2010/0276208 A1 11/2010 Sue
2011/0108326 A1 5/2011 Jones
2011/0297454 A1 12/2011 Shen
2012/0097456 A1 4/2012 Mirchandani
2012/0125695 A1 5/2012 Vempati et al.
2012/0247840 A1 10/2012 Vempati et al.
2013/0068449 A1 3/2013 Pillai
2013/0320598 A1 12/2013 Atkins et al.
2013/0333950 A1 12/2013 Atkins
2013/0333952 A1 12/2013 Bloomfield
2014/0326516 A1 11/2014 Haugvaldstad et al.
2014/0360792 A1 12/2014 Azar
2014/0367174 A1 12/2014 Siracki
2015/0129320 A1 5/2015 Overstreet et al.
2016/0083304 A1 3/2016 Mironets
2016/0089821 A1 3/2016 Atkins
2016/0258242 A1 9/2016 Hayter
2016/0279703 A1 9/2016 Clare
2016/0375493 A1 12/2016 Stoyanov
2017/0014901 A1 1/2017 Powell
2017/0037518 A1 2/2017 Oxford
2017/0050241 A1 2/2017 Thomas
2017/0072465 A1 3/2017 Welch
2017/0107764 A1 4/2017 Cook, III
2017/0211331 A1 7/2017 Vempati
2017/0342779 A1 11/2017 Cook, III
2018/0002986 A1 1/2018 Zhang
2018/0038167 A1 2/2018 Xu
2018/0058148 A1 3/2018 Zhang
2018/0162048 A1 6/2018 Gibson
2018/0297351 A1 10/2018 Welch
2018/0305266 A1 10/2018 Gibson
2018/0305790 A1 10/2018 Liu
2018/0312946 A1 11/2018 Gigliotti, Jr.
2018/0314645 A1 11/2018 Meredith et al.
2018/0320449 A1 11/2018 Zhang
2019/0071930 A1 3/2019 Hird
2019/0106941 A1 4/2019 Prichard
2019/0128072 A1 5/2019 Griffo
2020/0001367 A1 1/2020 Duffy et al.
2020/0003014 A1 1/2020 Howard
2020/0123858 A1 4/2020 Zhang et al.
2021/0222497 A1 7/2021 Zhang

FOREIGN PATENT DOCUMENTS

WO 2014149132 A2 9/2014
WO 2015031976 A1 3/2015
WO 2016200832 A1 12/2016
WO 2018050796 A1 3/2018
WO 2018200548 A8 11/2018

(56) References Cited

FOREIGN PATENT DOCUMENTS

OTHER PUBLICATIONS

DGM MORI Drill bit ultrasound grinding process, Ultrasonic 2nd Generation, Sauer Gmbh, Mar. 2015, 1 page.
International Search Report and Written Opinion issued in International Patent application PCT/US2021047731 on Dec. 22, 2021, 10 pages.
Business Wire, BlueFire Finalized Digital Model of Drill Bit for 3D Printing, https://www.businesswire.com/news/home/20131205005411/en/BlueFire-Finalizes-Digital-Model-Drill-Bit-3D, Houston, Texas, Dec. 5, 2013, 2 pages.
Industrial Laser Solutions, Drill bit innovator exploring 3D laser manufacturing systems. https://www.industrial-lasers.com/articles/2013/09/drill-bit-innovator-exploring-3d-laser-manufacturing-systems.html, Houston, Texas, Sep. 30, 2013, 2 pages.

* cited by examiner

BLADE COVER

CROSS-REFERENCE TO RELATED APPLICATIONS

This application is a national stage entry under 35 U.S.C. 371 of International Application No. PCT/US2021/047731 entitled "Blade Cover" and filed on Aug. 26, 2021, which claims the benefit of, and priority to, U.S. patent application Ser. No. 63/071,188 entitled "Blade Cover" and filed on Aug. 27, 2020, which is incorporated herein by reference in its entirety.

BACKGROUND OF THE DISCLOSURE

Drilling is the process by which resources located in an underground formation are accessed. Downhole drilling may rotate a bit or other downhole tool to erode the formation, thereby creating a wellbore that may be thousands of feet deep. Cutting elements may be attached to the bit to erode the formation. The bit may experience wear from the formation, drilling fluid, cuttings, and other downhole elements.

SUMMARY

In some embodiments, a blade cover includes a pre-sintered cover leading face that connects to a body leading face of a blade on a bit or other downhole tool. A pre-sintered cover outer face connects to a body outer face of the blade. The cover outer face extends from a leading face of the blade and past a trailing edge of a cutter pocket on an outer surface of the blade. The cover leading face and the cover outer face are integrally formed.

In some embodiments, a bit includes a body and a blade. A blade cover is brazed to the blade with a cover braze, and a cutting element is connected to the blade. The cutting element includes an ultrahard material connected to a substrate. A line drawn through the blade contacts the cutting element, the blade cover, the cover braze, and the blade.

In some embodiments, a method of forming a bit includes providing a bit body, the bit body including a blade with a body leading face and a body outer face. The method includes providing a pre-sintered blade cover having a cover leading face and a cover outer face. The blade cover is connected to the blade such that the cover leading face covers at least part of the body leading face and the cover outer face covers at least part of the body outer face.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 3-1 and FIG. 3-2 are representations of a perspective view of a bit, according to at least one embodiment of the present disclosure;

FIG. 4-1 through FIG. 4-3 are representations of a perspective view of another bit, according to at least one embodiment of the present disclosure;

FIG. 6-1 through FIG. 6-3 are representations of a leading face of a blade, according to at least one embodiment of the present disclosure;

FIG. 7-1 through FIG. 7-3 are representations of an outer face of a blade, according to at least one embodiment of the present disclosure;

DETAILED DESCRIPTION

This disclosure generally relates to devices, systems, and methods for forming a bit or other downhole tool for use in downhole drilling. A downhole tool includes a body, which may include one or more blades extending therefrom. A pre-sintered blade cover may be connected to one of the blades on the downhole tool, such as by braze or by mechanical fastener. The blade cover may extend over a portion of the leading edge of the blade and encompass a cutting element on the outer face of the blade. By having a seamless transition between the leading face and the outer face of the blade cover, the blade cover may reduce erosion and/or wear of the outer surface of the blade, thereby increasing the life of the bit. According to embodiments of the present disclosure, the downhole tool may include any downhole tool, including a bit, including reamers, hole openers, mills, casing cutters, stabilizers, bi-center bits, and so forth. While embodiments of the present disclosure may be described in reference to a bit, it should be understood that the embodiments described herein may refer to any downhole tool.

According to embodiments of the present disclosure, cutter pockets for cutting elements may be separately formed on the blade of the downhole tool and on the blade cover. When the blade cover is connected to the blade, the cutter pockets may align, and cutting elements may then be installed in the final cutter pocket on the assembled blade. In some embodiments, the cutter pockets may be machined into the blade after the blade cover is connected to the blade. This may prevent misalignment of the respective cuter pockets between the blade cover and the blade, thereby improving the fit of the cutting elements to the blade and/or reducing final machining costs.

Figure 1:
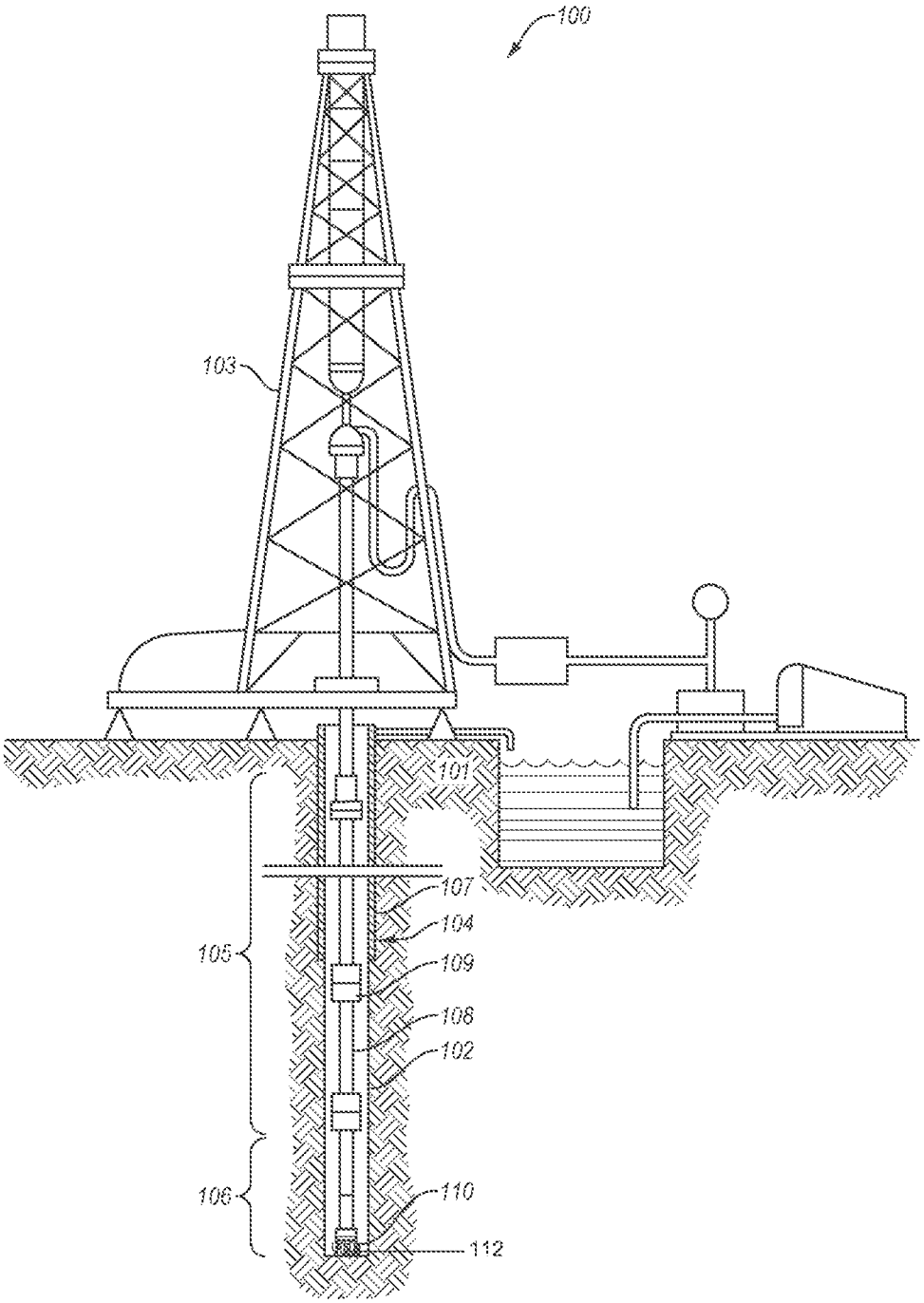
FIG. 1 is a representation of a drilling system, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface or may be allowed to fall downhole.

In some embodiments, the bit 110 may include one or more cutting elements 112. As the bit 110 rotates, the cutting elements 112 may erode the formation 101, advancing the wellbore 102. Cuttings, the formation, drilling fluid, and other drilling elements may wear the bit 110 and/or the cutting elements 112. A hardfacing material placed on high-wear portions of the bit 110 may reduce wear on the bit 110. According to embodiments of the present disclosure, the hardfacing material may include a pre-sintered blade cover that surrounds at least one cutting element 112 of the bit 110. This may help to reduce wear on the bit 110.

Figure 2:
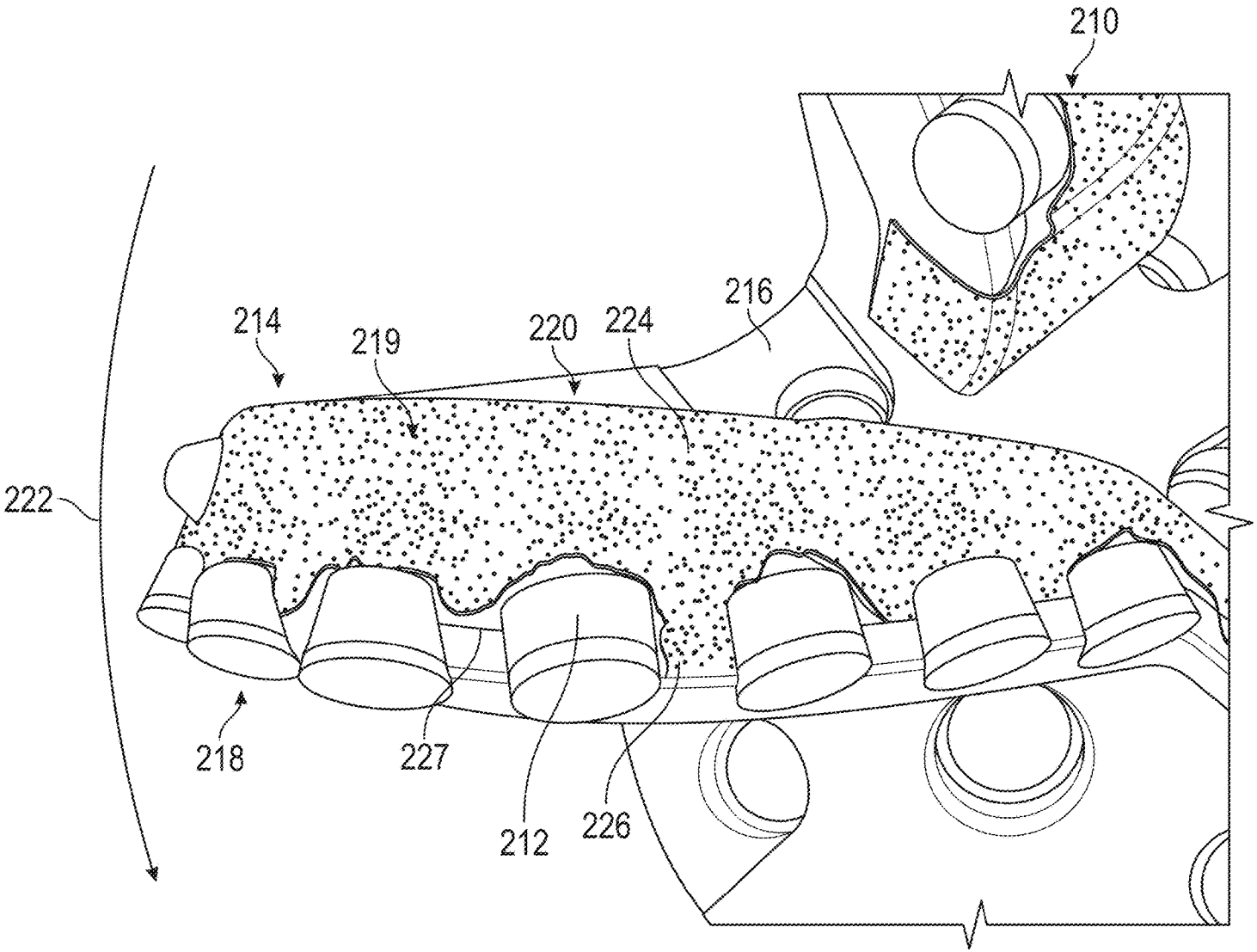
FIG. 2 is a representation of a top view of an example bit.

FIG. 2 is a representation of an example of a blade 214 connected to a bit body 216 of a bit 210. The blade 214 includes a leading face 218 that precedes an outer face 219 as the bit 210 rotates in a direction of rotation 222, and a trailing face 220 that follows the leading face 218 and the outer face 219 in the direction of rotation 222. Conventionally, to reduce wear and/or erosion on the blade 214, hardfacing 224 is applied to the blade 214 on one or more of the leading face 218, the outer face 219, or the trailing face 220. The hardfacing 224 may have a higher hardness than a blade body of the blade, thereby improving the wear on the blade. The hardfacing 224 may be applied directly to the blade 214, such as by direct deposition, laser cladding, additive manufacturing, other mechanisms of directly applying the hardfacing 224 to the blade 214, or combinations thereof.

In some situations, different elements of the blade 214 may have differing hardnesses. For example, the hardfacing 224 may be harder and/or more wear/erosion resistant than a body of the blade 214. In some instances, a high-wear plate 226 may be from a material that is harder and/or more wear/erosion resistant than both the hardfacing 224 and the body of the blade 214. In some situations, the high-wear plate 226 may be placed at a high-wear or high-erosion location of the blade 214. In some situations, a portion of the blade 214 may experience high-wear and/or erosion. For example, in some instances high wear and/or erosion locations may include the nose, the cone, the shoulder, the gage, the leading face 218, the outer face 219, the trailing face 220, any other location on the blade 214, and combinations thereof. By placing the high-wear plate 226 at a high wear and/or erosion location, wear and/or erosion at that location may be reduced. In some instances, the high-wear plate 226 may abut or be located next to the hardfacing 224 on the outer surface 219 of the blade 214 with a contact line 227.

At installation, the high-wear plate 226 may be at least partially in contact with the hardfacing 224 or there may be a gap between the high-wear plate 226 and the hardfacing 224. However, during use in a downhole environment (e.g., during drilling activities), drilling fluid, cuttings, and other material may cause erosion and/or wear of the hardfacing 224, the high-wear plate 226, and/or the body of the blade 214 at the contact point (e.g., at contact line 227) or the gap between the high-wear plate 226 and the hardfacing 224. This may result in increased wear on the cutting elements 212 and/or may wear away support for the cutting elements 212 in the blade 214. This may eventually result in the cutting elements 212 falling out of the blade 214. In at least one embodiment of the present disclosure, wear at the contact line 227 or gap may be reduced or prevented. For example, and not by way of limitation, as shown in FIG. 3-1, a blade cover 330 may be connected to the blade 314 without a gap between the leading face and the outer face or without a gap along the outer face.

Figure 3:
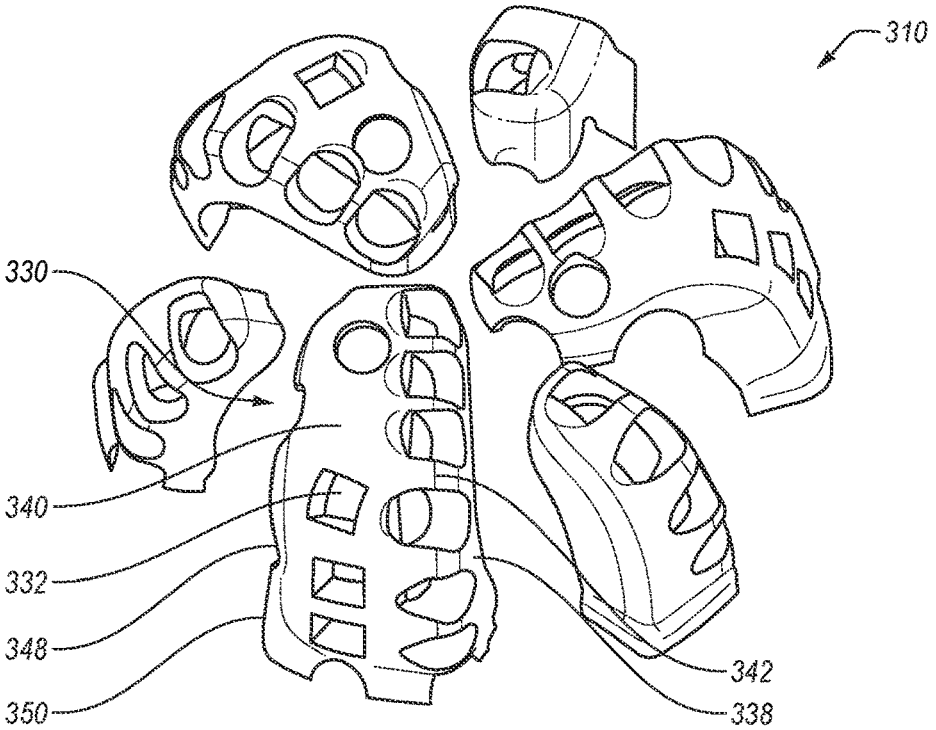
Figure 1:
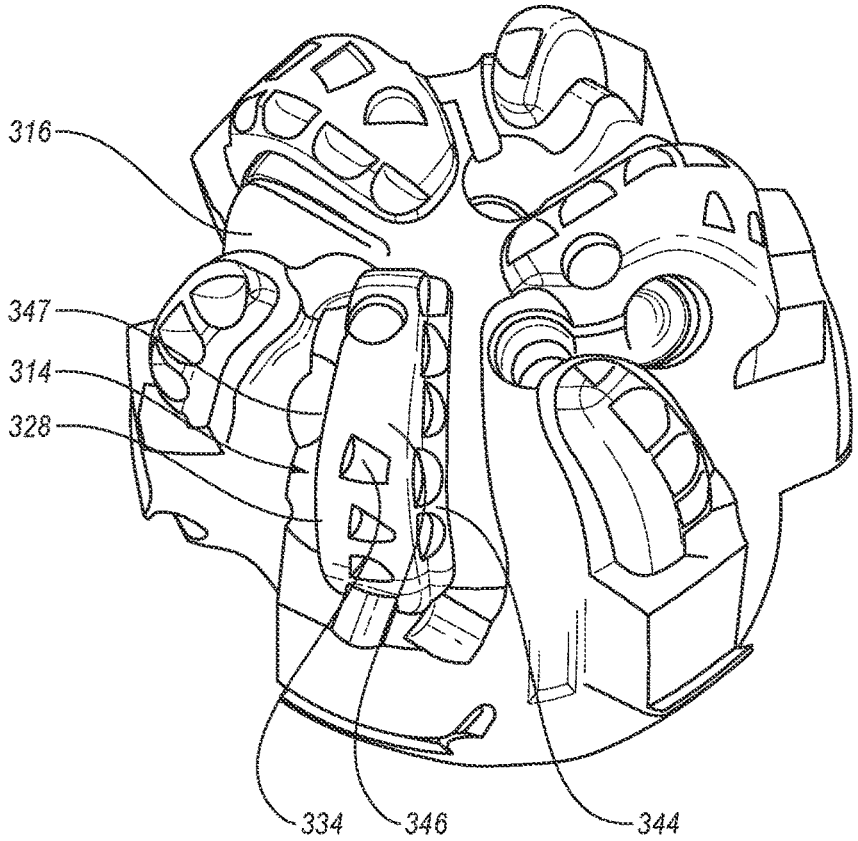
Figures 2, 3:
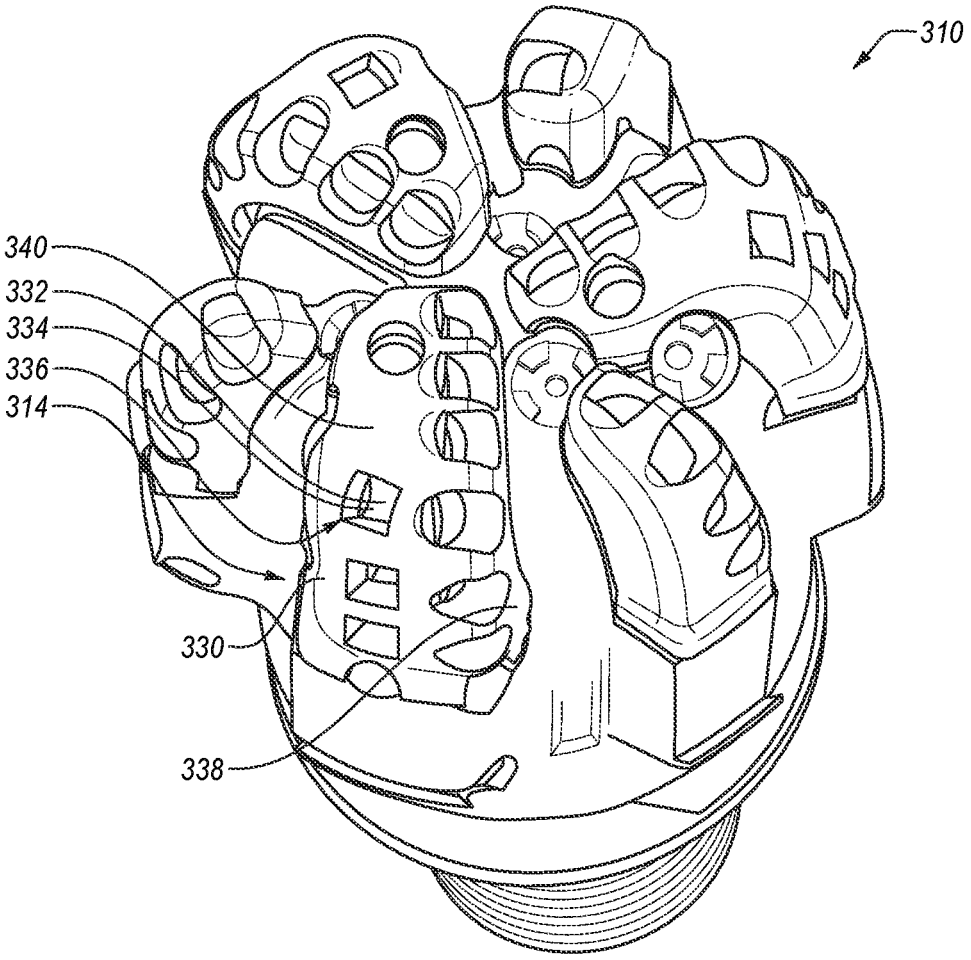

FIG. 3-1 is a representation of an exploded view of a bit 310, according to at least one embodiment of the present disclosure. The bit 310 may include a bit body 316, such as a steel bit body. The bit body 316 may include one or more blades 314. Each blade 314 may include a blade body 328. In some embodiments, the blade body 328 may be formed from the same material as the bit body 316. In some embodiments, the blade body 328 may be integral to the bit body 316. In some embodiments, the blade body 328 may be formed (e.g., machined, cast, or otherwise formed) from the bit body 316. In some embodiments, the blade body 328 may be independently or separately formed and subsequently attached to the bit body 316 by any connection mechanism, such as by mechanical connection, braze, weld, or other connection mechanism. In some embodiments, the blade body 328 may be formed from a different material than the bit body 316. For example, the blade body 328 may be formed of an infiltrated matrix material and/or a pre-sintered material that is tougher and/or more wear resistant than the bit body 316. In some embodiments, the blade body 328 may be formed with one or more recessed features on one or more of the leading face, the outer face, and the trailing face. In some embodiments, the depth of the recessed features may be uniform across the faces of the blade body 328. In some embodiments, the depth of the recessed features may vary across the faces of the blade body 328, by zones of the blade body 328, or any combination thereof.

The bit 310 may include a blade cover 330. The blade cover 330 may be configured to be connected to the blade body 328 to form the blade 314. In some embodiments, the blade cover 330 may be formed from a different material than the blade body 328. For example, the blade cover 330 may be formed from a pre-sintered material. The pre-sintered material may be more wear and/or erosion-resistant than the material of the blade body 328. In this manner, the blade cover 330 may reduce the wear on the blade 314. In some embodiments, the recessed features on the blade body 328 are configured to interface with complementary features of a blade cover 330 with minimal discontinuities between the blade cover 330 and an adjacent surface of the blade body 328. For example, the blade cover 330 may be configured to interface with the blade body 328 having surface discontinuities less than 0.20 in. (5.08 mm), 0.15 in. (3.81 mm), 0.10 in. (2.54 mm), or 0.05 in. (1.27 mm) relative to an adjacent surface of the blade body 328 that is not covered by the blade cover 330.

In some embodiments, the blade cover 330 may be any pre-sintered material. In some embodiments, the blade cover 330 may be formed by additive manufacturing. For example, the blade cover 330 may be formed by laying down a plurality of layers of a granular material. An energy source, such as a laser, may heat each layer to a sintering or a melting temperature. This may cause the particles to bind and/or melt together. As each successive layer is added, the blade cover 330 may begin to take shape. In some embodiments, additively manufacturing may form materials that exhibit a high hardness and/or wear resistance. Therefore, by pre-sintering the blade cover 330 using additive manufacturing, a wear resistant blade cover 330 may be formed apart from the blade body 328. The blade cover 330 may be attached to the blade body 328 to improve the wear and/or erosion resistance of the blade 314. In some embodiments, pre-sintering the blade cover 330 using additive manufacturing may allow for complex geometries to be easily determined and formed, without creating a new cast or mold for each blade body 328. That is, different blade covers 330 formed with different quantities or arrangements of cutters may be configured for attachment to the same blade body 328.

In some embodiments, pre-sintering the blade cover 330 may include casting the blade cover 330. To cast the blade cover 330, a mold may be filled with a granular material, and the granular material may be raised to a sintering temperature to sinter the grains of material together. In some embodiments, a binder, may be added to the cast during sintering. The binder may serve to bind the granular particles together prior to, during, and/or after sintering the blade cover 330. In some embodiments, the binder may be melted during sintering.

In some embodiments, the granular material used to pre-sinter the blade cover 330 may include an ultra-hard material. As used herein, the term "ultrahard" may refer to refer to those materials known in the art to have a grain hardness of about 1,500 HV (Vickers hardness in kg/mm2) or greater. Such ultrahard materials can include but are not limited to carbides, such as tungsten carbide (WC), titanium carbide (TiC), chromium carbide, silicon carbide (SiC), boron carbide (BC), diamond, sapphire, moissantite, hexagonal diamond (Lonsdaleite), cubic boron nitride (cBN), polycrystalline cBN (PcBN), Q-carbon, binderless PcBN, diamond-like carbon, boron suboxide, aluminum manganese boride, metal borides, boron carbon nitride, PCD (including, e.g., leached metal catalyst PCD, non-metal catalyst PCD, and binderless PCD or nanopolycrystalline diamond (NPD)) and other materials in the boron-nitrogen-carbon-oxygen system which have shown hardness values above 1,500 HV, as well as combinations of the above materials. In some embodiments, the ultrahard material may have a hardness value above 3,000 HV. In other embodiments, the ultrahard material may have a hardness value above 4,000 HV. In yet other embodiments, the ultrahard material may have a hardness value greater than 80 HRa (Rockwell hardness A). In some embodiments, the blade cover may be formed from any high-wear resistant material. In some embodiments, the blade cover 330 may be formed from carbide particles, such as WC, sintered in a copper or nickel alloy binder.

In some embodiments, the blade cover 330 may be partially sintered. For example, when forming the blade cover 330, the sintering process may not be completed, such as by not reaching the full sintering temperature and/or by not spending time at the sintering temperature. The blade cover 330 may finish sintering when assembled on the bit 310, such as when brazed to the blade body 328.

The blade may include one or more cutter pockets to attach cutting elements to the blade 314. In some embodiments, the cutter pockets may be pre-formed on the blade body 328 and the blade cover 330. For example, the blade cover 330 may be manufactured (e.g., printed or cast) or machined with cover cutter pockets 332. The blade body 328 may be manufactured (e.g., printed or cast) or machined with body cutter pockets 334. According to embodiments of the present disclosure, when the blade cover 330 is connected to the blade body 328, the cover cutter pockets 332 may align with the body cutter pockets 334 to form the final cutter pocket. In this manner, the final cutter pocket may be formed from the alignment of the cover cutter pockets 332 and the body cutter pockets 334. This may help to reduce or eliminate the amount of post-assembly machining and/or processing of the blade 314 to form the final cutter pocket.

In some embodiments, the blade body 328 has a blade profile, which may be the three-dimensional shape of the blade body 328. In other words, the blade profile may be the outer profile or shape of the blade body 328. The blade cover 330 has a cover profile, which may be the three-dimensional shape of the inside of the blade cover 330. In other words, the cover profile may be the inner profile or shape of the blade cover 330. In some embodiments, the blade profile and the cover profile may be complementary. In other words, the cover profile may have the same or substantially the same shape (e.g., having the same bumps, ridges, curves, and other geometric features) and the same or substantially the same dimensions (e.g., within 2.5 mm, within 1 mm, within 0.5 mmm, within less than 0.25 mm) the blade profile. In this manner, the blade cover 330 may be installed over the blade body 328 with a tight gap in between the blade cover and blade body.

In some embodiments, the blade profile may include one or more keying or locking features. For example, the blade profile may include a ridge, bump, detent, indentation, or other feature. The cover profile may include a complementary protrusion, indentation, recess, or other matching feature. When the blade cover 330 is connected to the blade body 328, the matching or complementary features may align. This may improve the strength of the connection between the blade cover 330 and the blade body 328 and may improve the alignment of the blade cover 330 on the blade body 328.

In some embodiments, the blade cover 330 may be connected to the blade body 328 with any type of connection. For example, the blade cover 330 may be brazed, welded, connected with a mechanical fastener or pins, connected through any other mechanism, and combinations thereof to the blade body 328. In some embodiments, the blade cover 330 may be brazed to the blade body 328. In some embodiments, the blade cover 330 and the blade body 328 may be submerged in a molten liquid binder (e.g., copper or nickel alloys) to connect the blade cover 330 to the blade body 328.

In some embodiments, the bit 310 may include a plurality of blades 314. In some embodiments, each blade 314 of the plurality of blades 314 may have a blade cover 330. In some embodiments, the blades 314 that experience the highest amount of wear and/or erosion may have a blade cover 330. For example, the bit 310 may include primary and secondary blades. In some embodiments, the primary blades may include a blade cover 330, and the secondary blades may not include a blade cover 330.

The blade cover 330 includes a cover leading face 338 and a cover outer face 340. The cover leading face 338 may be connected to the cover outer face 340 by a cover leading edge 342. The blade cover 330 may be integrally formed (e.g., pre-sintered) such that there is no seam, joint, discontinuity, line, or other physical break at the cover leading edge 342 (e.g., between the cover leading face 338 and the cover outer face 340). That is, at least portions of the blade cover 330 are continuous from the cover leading face 338 below a cutter pocket 332, across the cover leading edge 342, and to a trailing edge of the one of the cover outer face 340. In some embodiments, the cover leading edge 342 between the cover leading face 338 and the cover outer face 340 may be seamless. In this manner, when the blade cover 330 is connected to the blade body 328, erosion and wear of the outer face of the blade 314 may be prevented or reduced at the cover leading edge 342 and any joint between hardfacing applied to a body outer face 346 of the blade body 328.

The blade body 328 may include a body leading face 344, a body outer face 346, and a body trailing face 347. In some embodiments, the body leading face 344 may be separated from the body trailing face 347 by the body outer face 346. In some embodiments, the body leading face 344 may be adjacent to the body outer face 346, and the body outer face 346 may be adjacent to the body trailing face 347. In some embodiments, when the blade cover 330 is installed on the blade body 328, the cover leading face 338 may cover the blade leading face 344 and the cover outer face 340 may cover the blade outer face 346. In this manner, the blade leading face 344 may be protected from wear and/or erosion by the cover leading face 338 and the blade top face 346 may be protected from wear and/or erosion by the cover outer face 340.

In some embodiments, the cover leading face 338 may be configured to connect to the body leading face 344. In some embodiments, the cover leading face 338 may, when the blade cover 330 is connected to the blade body 328, cover at least a portion of the body leading face 344. In some embodiments, the cover leading face 338 may be brazed to the body leading face 344.

In some embodiments, blade cover 330 may include a cover trailing face 348. The cover trailing face 348 may be integrally formed (e.g., pre-sintered) as part of the blade cover 330. In other words, there may be no seam, joint, discontinuity, line, or other physical break at the cover trailing edge 350. That is, at least portions of the blade cover 330 are continuous from the cover leading face 338 below a cutter pocket 332, across the cover leading edge 342, across the cover outer face 340, across the cover trailing edge 350 and to a trailing edge of the body trailing face 347 of the blade cover 330. In this manner, when the blade cover 330 is connected to the blade body 328, erosion and wear of the outer face of the blade 314 may be prevented or reduced by eliminating any joint or other physical discontinuity on the outer face of the blade 314.

In some embodiments, the cover trailing face 348 may be configured to connect a body outer face 346. In some embodiments, the cover trailing face 348 may, when the blade cover 330 is connected to the blade body 328, cover at least a portion of the body outer face 346. In some embodiments, the cover trailing face 348 may be brazed to the body outer face 346.

In some embodiments, the cover trailing face 348 may be configured to connect a body trailing face 347. In some embodiments, the cover trailing face 348 may, when the blade cover 330 is connected to the blade body 328, cover at least a portion of the body trailing face 347. In some embodiments, the cover trailing face 348 may be brazed to the body trailing face 347.

It should be understood that the body outer face 346 and the cover outer face 340 may refer to outermost face of the blade 314. This may include any zone or portion of the blade 314, including the crown, the nose, the shoulder, the gage, or any other zone of the blade 314. The outer face may be continuous from the gage zone through to the radially innermost portion of the blade. In some embodiments, the outer face may be the portion of the blade 314 that is furthest from a longitudinal axis of the bit 310.

In some embodiments, the blade cover 330 may surround one or more cover cutter pockets 332. In other words, the cover cutter pocket 332 may be a hole in the blade cover 330 such that a cutting element inserted into the cover cutter pocket may be surrounded by the material of the blade cover 330. In some embodiments, the blade cover 330 may surround a plurality of cover cutter pockets 332. In some embodiments, the blade cover 330 may surround a cover cutter pocket 332 for each cutting element to be installed on the blade 314.

In some embodiments, the cover leading face 338 may at least partially include or encompass one or more cover cutter pockets 332. In some embodiments, the cover leading face 338 may fully include or encompass one or more cover cutter pockets 332 such that the one or more cover cutter pockets 332 does not extend into the cover outer face 340.

In some embodiments, the cover outer face 340 may at least partially include or encompass one or more cover cutter pockets 332. In some embodiments, the cover outer face 340 may fully include or encompass one or more cover cutter pockets such that the one or more cover cutter pockets 332 does not extend into the cover leading face 338. In some embodiments, a cover cutter pocket 332 may extend between both the cover outer face 340 and the cover leading face 338. That is, the cover cutter pocket 332 may extend through the cover leading edge 342 of the blade cover 330.

FIG. 3-2 is a representation of the assembled bit 310 of FIG. 3-1. In the embodiment shown, each blade 314 includes a blade cover 330 connected to a blade body. Furthermore, as may be seen, the cover cutter pockets 332 are aligned with the body cutter pockets 334 to form a final cutter pocket 336. A cutting element may be installed in the final cutter pocket 336 prior to use.

As may be seen, the cover leading face 338 and the cover outer face 340 may extend over the blade body 328. Indeed, in the embodiment shown, no portion of the blade body is left uncovered by the blade cover 330. In other words, there is no joint or physical discontinuity between the blade cover 330 and the blade 314 at the cover outer face. In this manner, wear and/or erosion of the blade 314 may be prevented and/or reduced by reducing or eliminating a catalyst for erosion (e.g., the joint or physical discontinuity between the blade cover 330 and other hardfacing).

In some embodiments, after the blade cover 330 is installed on the blade body, due to manufacturing tolerances, there may be a mismatch between the cover cutter pocket 332 and the body cutter pocket 334 and/or the final cutter pocket 336 may be too small to receive the cutting element. The final cutter pocket 336 may be processed (e.g., machined) after assembly to finish the final cutter pocket 336 to the final dimension.

Figures 1, 4:
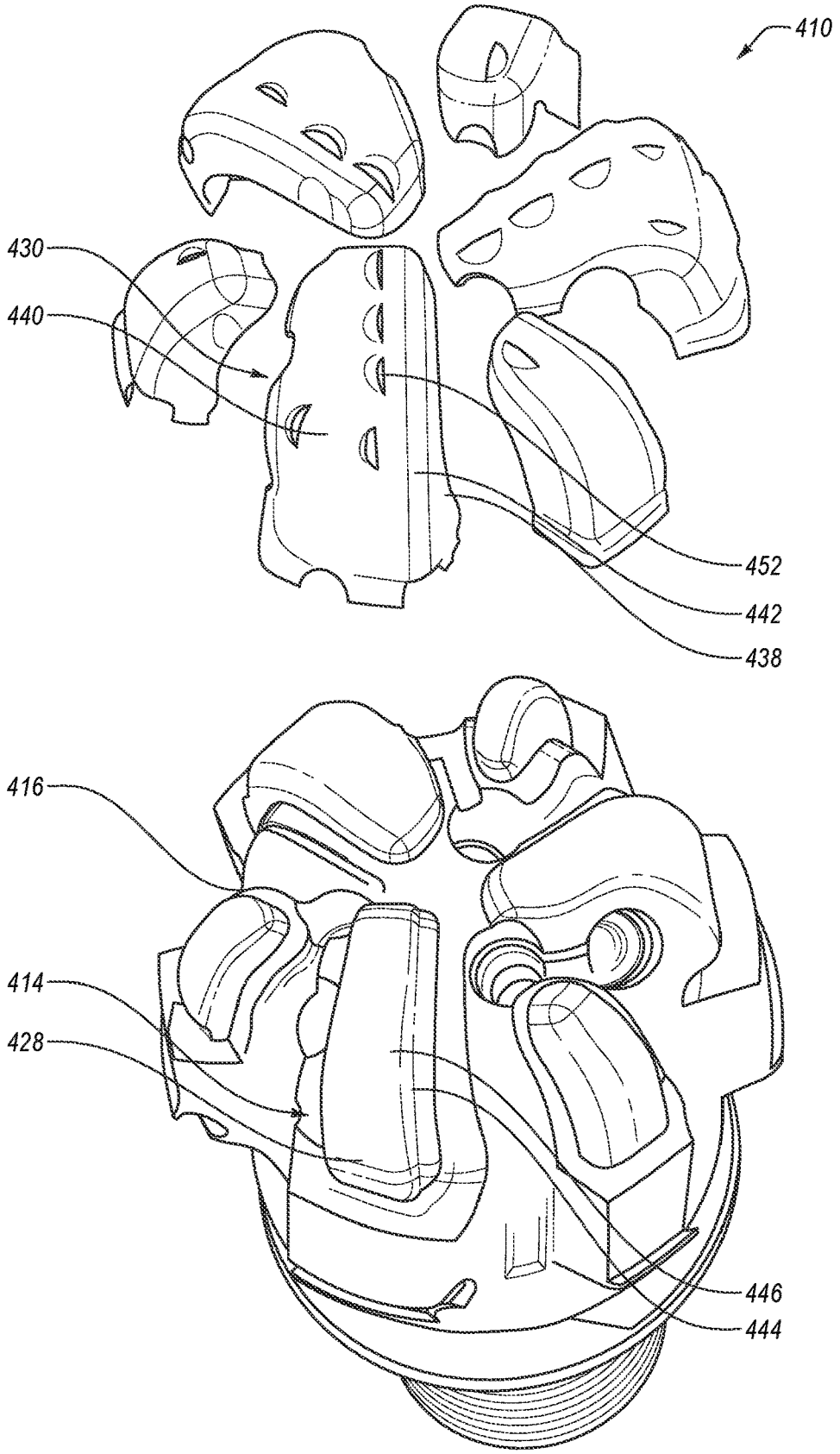
Figures 2, 4:
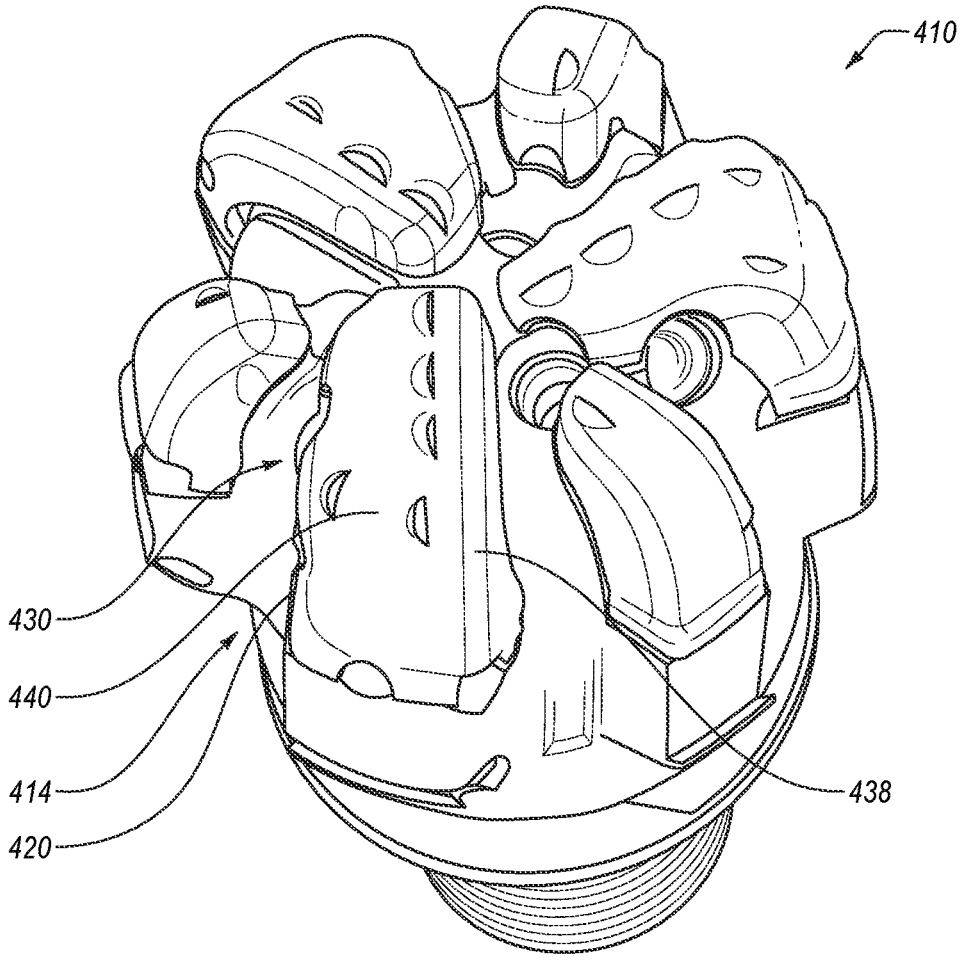
Figures 3, 4:
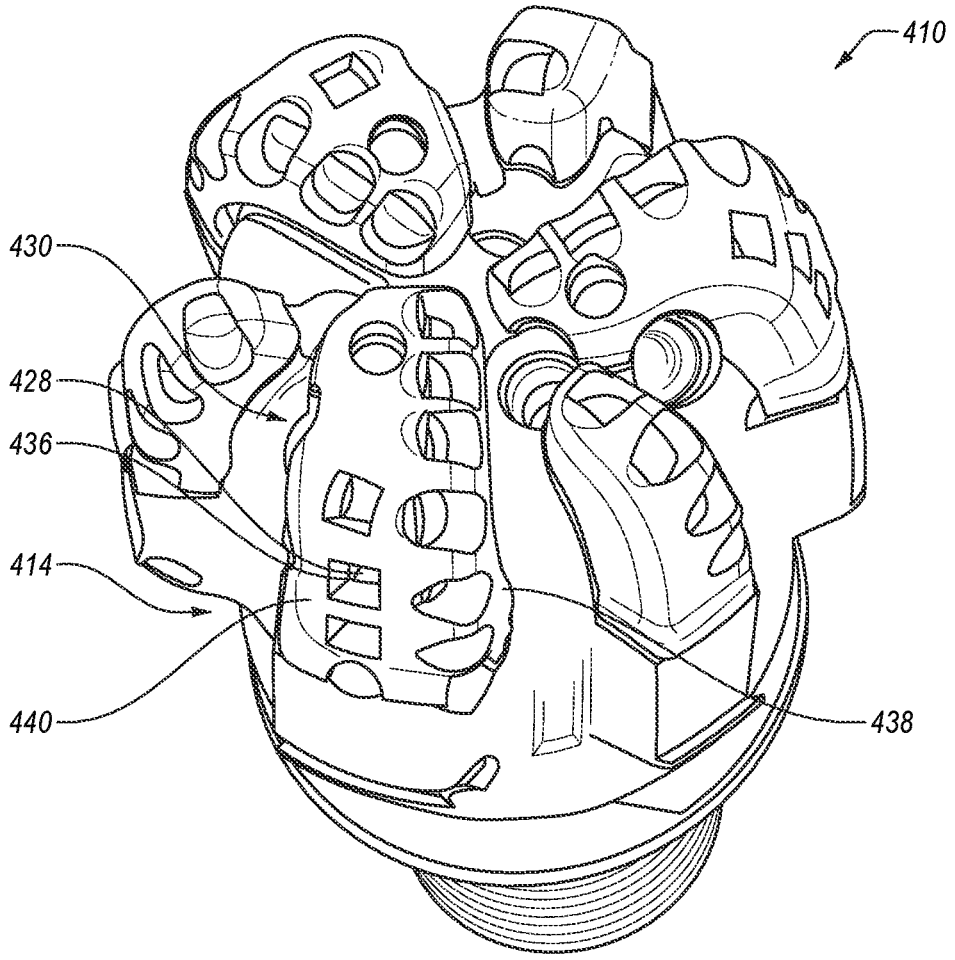

FIG. 4-1 is a representation of an exploded view of a bit 410, according to at least one embodiment of the present disclosure. In the embodiment shown, the bit 410 includes a bit body 416 with at least one blade 414. The bit body 416 includes a blade body 428 having a body leading face 444 and a body outer face 446.

The bit 410 includes one or more blade covers 430. The blade cover 430 includes a cover leading face 438 and a cover outer face 440 connected at a cover leading edge 442. Similar to the blade cover 330 discussed above with respect to FIG. 3-1 and FIG. 3-2, the blade cover 430 may be pre-sintered. Furthermore, the cover leading face 438 and the cover outer face 440 may be integrally formed such that there is no seam, joint, discontinuity, line, or other physical break at the cover leading edge 442.

As discussed above, pre-forming the cover cutter pocket (e.g., the cover cutter pocket 332 of FIG. 3-1) and the body cutter pocket (e.g., the body cutter pocket 334 of FIG. 3-2) may result in misalignment. This may cause ledges or other misalignment features that may be machined into a final dimension prior to fitting the cutting elements. Furthermore, pre-formed cutter pocket dimensions may vary somewhat due to manufacturing tolerances of the blade cover 430, which may result in additional post-assembly machining and/or cutter pockets that are too large or too small for a cutting element.

According to embodiments of the present disclosure, the blade body 428 and the blade cover 430 may not include any pre-manufactured or pre-machined cutter pockets. As may be seen in FIG. 4-1, the profile of the blade body 428 may be smooth, and the outer profile of the blade cover 430 may not include any cover cutter pockets manufactured or machined into the blade cover 430. In some embodiments, as may be seen in FIG. 4-1, the blade cover 430 may include one or more cutter supports 452, which may provide support for a cutting element after it has been installed. In some embodiments, the blade cover 430 may have a smooth outer surface. In some embodiments, the blade body 428 may include one or more keying or locking features. For example, the blade body 428 may include a ridge, bump, detent, indentation, or other feature. The blade cover 430 profile may include a complementary protrusion, indentation, recess, or other matching feature on an inner surface. When the blade cover 430 is connected to the blade body 428, the matching or complementary features may align. This may improve the strength of the connection between the blade cover 430 and the blade body 428 and may improve the alignment of the blade cover 430 on the blade body 428. Complementary interface features between the blade cover 430 and the blade body 428 may aid alignment of the components while reducing or eliminating tolerance issues of partially or fully formed cutter pockets of the blade cover and blade body.

FIG. 4-2 is a representation of the assembled bit 410 of FIG. 4-1. As may be seen, the blade cover 430 has been connected to the blade body 428 seen in FIG. 4-1. As discussed above, the blade cover 430 may be connected to the blade body 428 using any connection mechanism, such as brazing, mechanical fastener, welding, and combinations thereof.

As may be seen, the blade cover 430 has a cover leading face 438 that is seamlessly connected to the cover outer face 440. In some embodiments, the blade cover 430 seamlessly connects the cover leading face 438, the cover outer face 440, and a cover trailing face 420. Indeed, the blade cover 430 shown is smooth, and does not include any cutter pockets. In some embodiments, cutter pockets may be partially formed in the blade cover 430, thereby reducing machining of the blade cover upon assembly. In some embodiments, cutter pockets may be machined, milled, ground, or otherwise added to the blade 414 after the bit 410 has been assembled.

FIG. 4-3 is a representation of the assembled bit 410 of FIG. 4-2 after one or more cutter pockets 436 have been formed on the blade 414. To form a cutter pocket 436, a portion of the blade cover 430 is removed. In some embodiments, the blade cover 430 may be removed, exposing a portion of the blade body 428 beneath. In some embodiments, a portion of the blade cover 430 and a portion of the blade body 428 may be removed to form the cutter pocket 436. In some embodiments, only a portion of the blade cover 430 may be removed, without removing any portion of the cutter pocket 436. Thus, in some embodiments, a cutter pocket 436 may include at least a portion of blade cover 430 material and at least a portion of blade body 428 material.

In some embodiments, a single row of cutter pockets 436 may be formed on the blade 414. In some embodiments, two or more rows of cutter pockets may be formed on the blade 414. In some embodiments, each cutter pocket 436 may be formed on the blade 414 after the blade cover 430 is attached to the blade body 428. In some embodiments, some cutter pockets 436 may be formed after the blade cover 430 is attached to the blade body and some cutter pockets 436 may be formed during manufacturing and/or processing of the blade cover 430 and the blade body 428 prior to assembly, and the cutter pocket 436 formed based on alignment of a cover cutter pocket (e.g., cover cutter pocket 332 of FIG. 3-1) and a body cutter pocket (e.g., body cutter pocket 334 of FIG. 3-1).

In some embodiments, the cutter pocket 436 may be formed using any subtractive manufacturing process. For example, the cutter pocket 436 may be formed using EDM, a CNC milling machine, grinding, cutting, or any other manufacturing process. In some embodiments, the cutter pocket 436 may be formed using ultrasonic grinding. In some embodiments, ultrasonic grinding may facilitate rapid and cost-effective removal of the ultrahard material of the blade cover 430. Therefore, by using ultrasonic grinding to form the cutter pocket 436, the blade cover 430 may be formed more quickly and cost-effectively. In some embodiments, ultrasonic grinding of the cutter pockets 436 may form any type of cutter pocket. The cutter pockets 436 may be formed to support any orientation of cutting element.

The cutter pockets 436 may be formed with a cutter pocket profile. Because the cutter pockets 436 are formed after the blade cover 430 is installed on the blade body 428, the cutter pocket profile for each cutter pocket 436 may be matched to the cutting element that will be installed in the cutter pocket 436. Indeed, forming the cutter pockets after assembly of the blade 414 may help the cutter pocket 436 to be sized to match the cutting element. This may improve the fit of the cutting element in the cutter pocket 436. Furthermore, because the cutter pocket profile matches the cutting element, this may improve the retention of the cutting element in the cutter pocket.

In some embodiments, forming the cutter pocket 436 after the blade cover 430 is installed on the blade body 428 may increase the accuracy of placement and orientation of the cutting elements. For example, each cutting element may have a design orientation, which may include angles such as a rake angle and a face angle. By forming the cutter pocket 436 on the blade 414, the actual orientation may match, or be closer to, the design orientation than by pre-forming cover cutter pockets and body cutter pockets, and aligning them at installation.

In some embodiments, the transition between blade cover 430 and blade body 428 in the cutter pocket 436 may be smooth. In other words, because the cutter pocket 436 is formed after the blade cover 430 is connected to the blade body 428, the machining process may machine the entire cutter pocket 436 with the same surface finish or roughness. Furthermore, there may be no ledge or other change in profile at the interface between the blade cover 430 and the blade body 428 in the cutter pocket 436. Ledges at that interface may be the result of slight changes in the dimensions of the cover cutter pocket and the blade cutter pocket caused by differences in manufacturing processes and tolerances.

Figure 5:
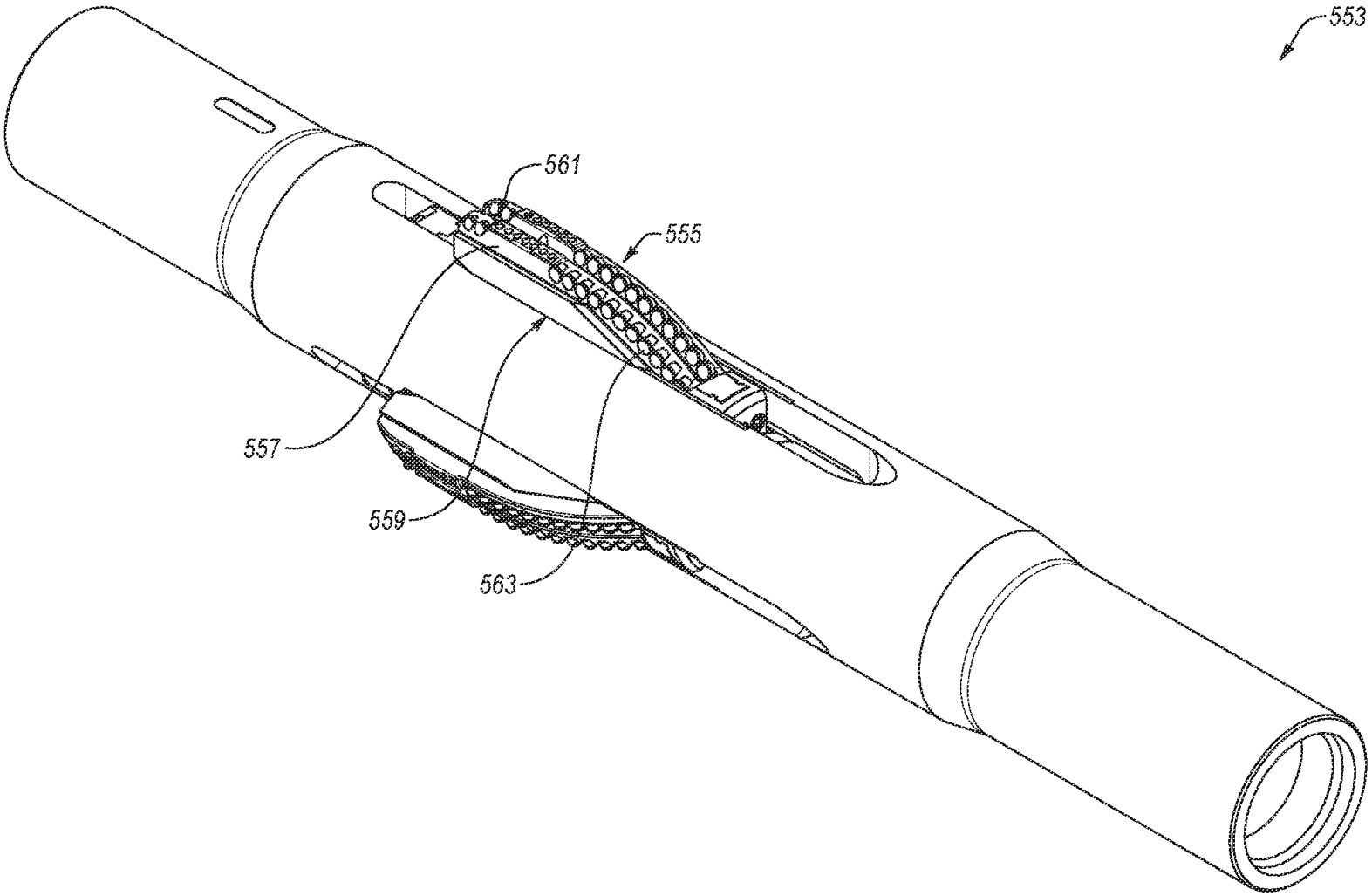
FIG. 5 is a representation of a reamer, according to at least one embodiment of the present disclosure.

The blade cover 430 of the present disclosure may be used with any downhole tool. For example, the blade cover 430 may be used to form blades, blocks, fins, or any other element of a downhole tool that is exposed to high wear and/or erosion conditions. For example, FIG. 5 is a representation of a reamer 553 having a plurality of reamer blocks 555. The reamer block 555 shown includes a block cover 557. The block cover 557 may cover at least a portion of a block leading face 559 and a portion of a block outer face 561 of the reamer block 555. In this manner, the reamer block 555 may experience greater wear and/or erosion resistance.

In the embodiment shown, the reamer block 555 includes two rows of cutting elements 563. In some embodiments, the block cover 557 may extend past a trailing edge of the first row of cutting elements 563. In some embodiments, the block cover 557 may extend past the trailing edge of both rows of cutting elements 563. In some embodiments, the block cover 557 may seamlessly extend from the block leading face 559, across the block outer face 561, and to a block trailing face. While the block cover 557 has been described herein with respect to a reamer 553, it should be understood that a block cover 557 may be used for any downhole tool, including reamers, hole openers, mills, casing cutters, stabilizers, bi-center bits, and so forth.

Figures 1, 6:
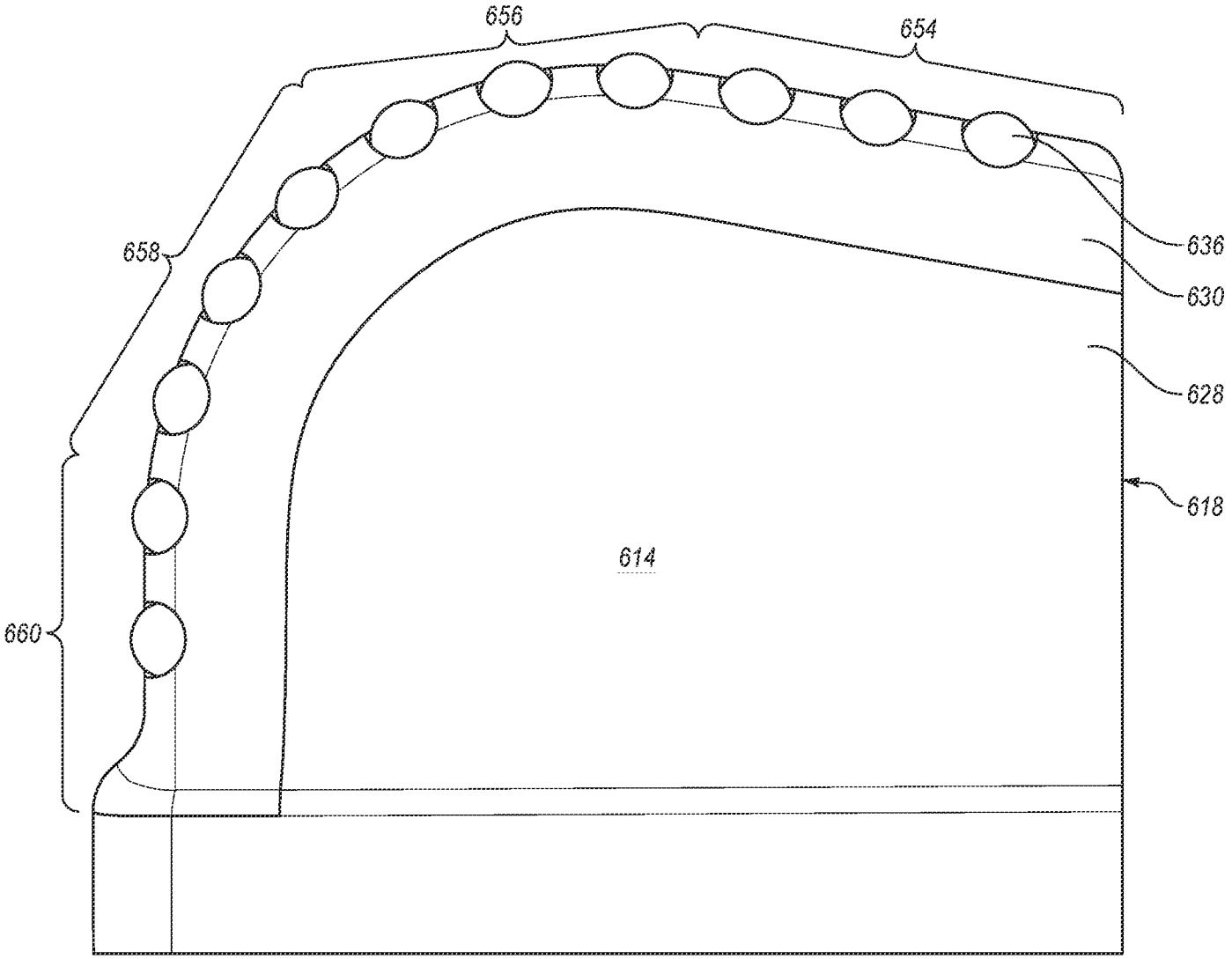
Figures 2, 6:
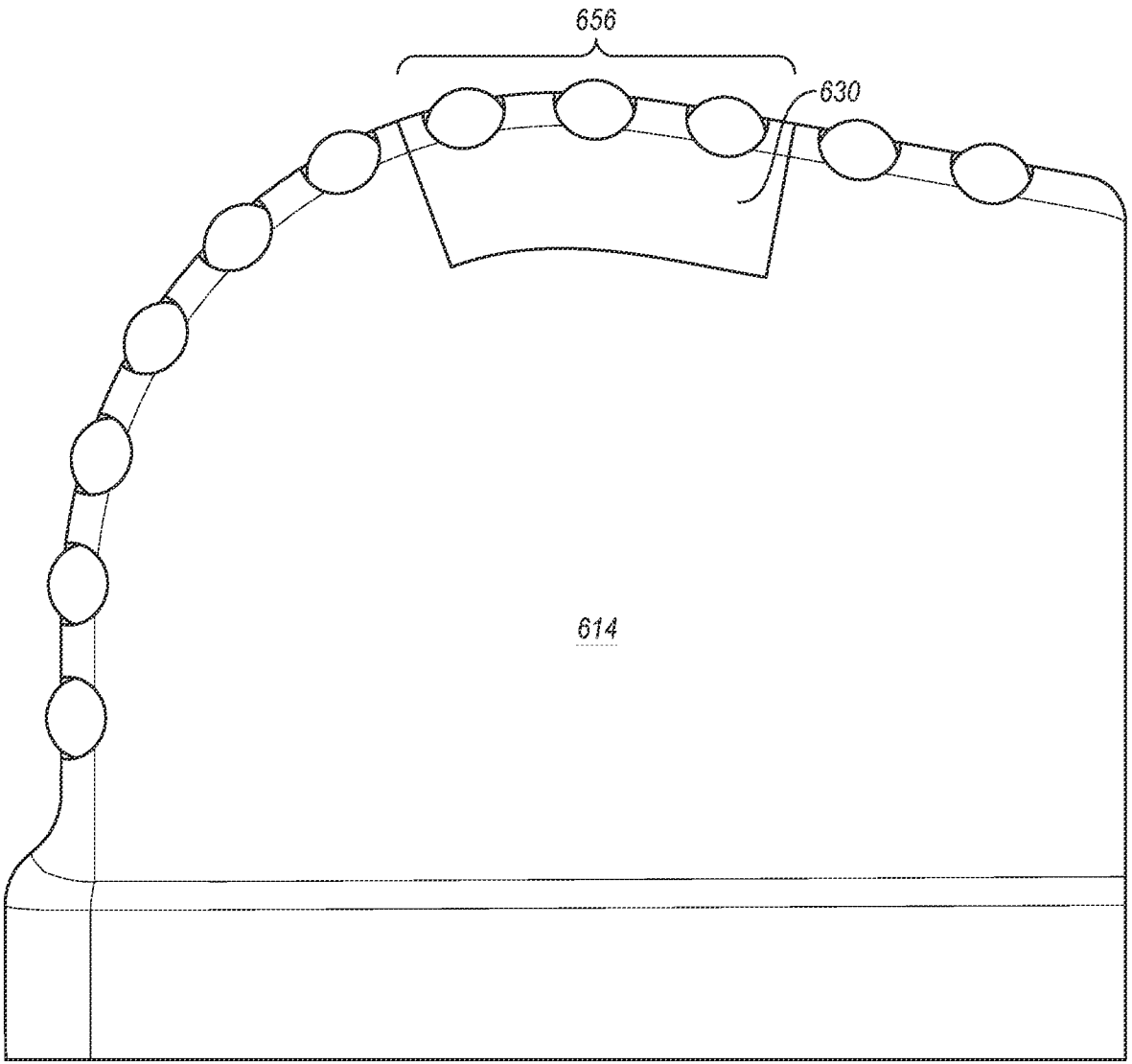
Figures 3, 6:
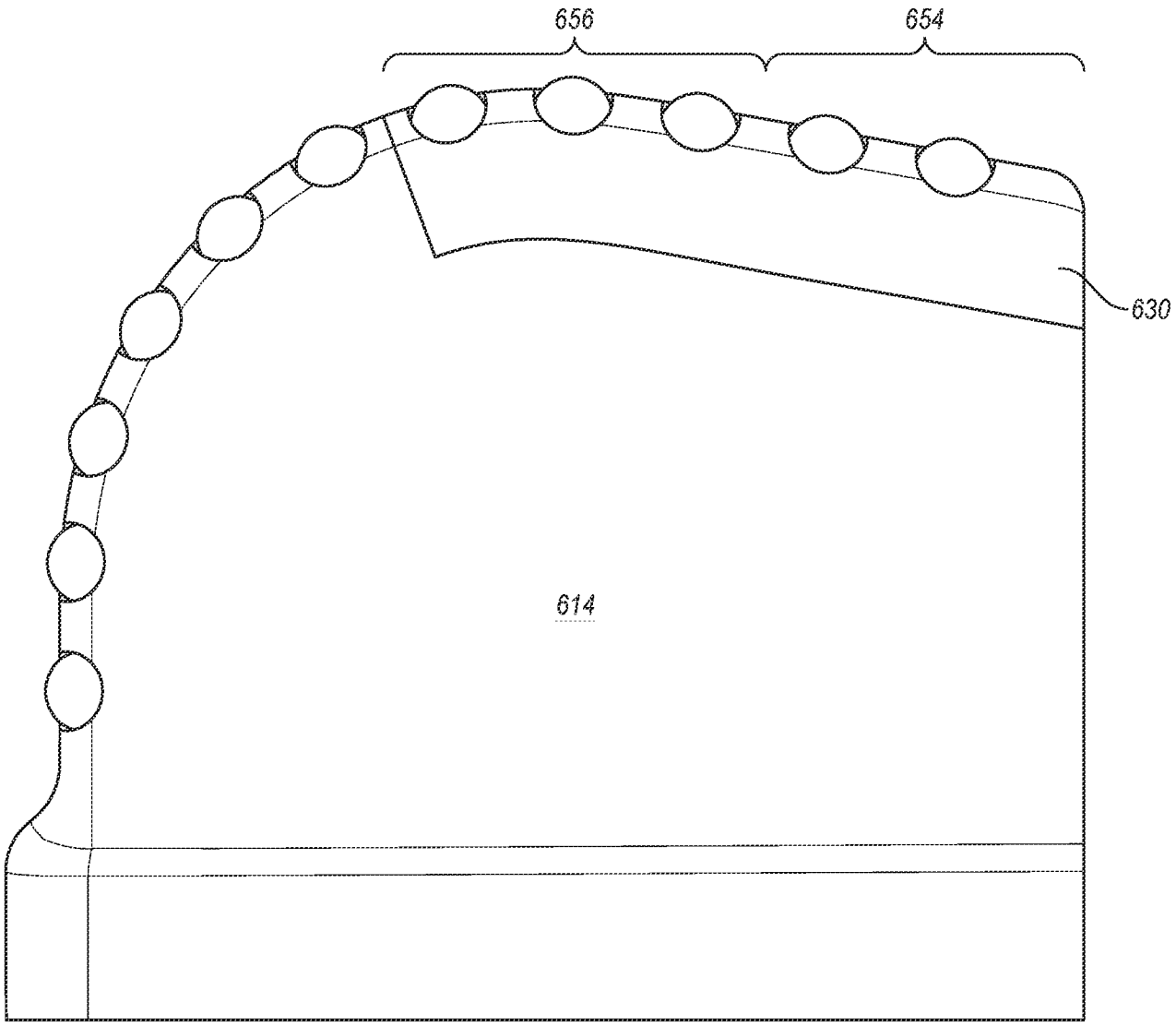

FIG. 6-1 through 6-3 are representations of a leading face 618 of a blade 614, according to at least one embodiment of the present disclosure. The blade 614 includes a blade cover 630 attached to a blade body 628. A plurality of cutter pockets 636 have been formed on the blade 614. In the embodiment shown in FIG. 6-1, the blade cover 630 does not cover an entirety of the leading face 618 of the blade 614. However, it should be understood that the blade cover 630 may cover the entirety of the blade 614 or any percentage of the leading face 618 of the blade 614.

The blade 614 may include cutting elements installed in the cutter pockets 636 in different regions or zones, including a cone 654, a nose 656, a shoulder 658, and a gage 660. Each of these regions may experience different forces and flows during drilling. Consequently, the cutting elements and the blade 614 may experience different rates of wear in these different regions.

According to embodiments of the present disclosure, the blade cover 630 may be attached to the blade 614 along an entirety of the blade 614. In other words, the blade cover 630 may cover the blade body 628 at each of the cone 654, the nose 656, the shoulder 658, and the gage 660. In some embodiments, one blade 614 may have separate blade covers 630 that collectively cover multiple regions or zones of the blade 614.

As may be seen in FIG. 6-2, in some embodiments the blade cover 630 may be attached to the blade along only a portion of the blade 614. For example, the blade cover 630 may be attached to the blade 614 at only the nose 656 region. Accordingly, one or more faces of the blade 614 at the nose region 656 may be formed (e.g., machined, cast) with recessed features complementary to the blade cover 630. In some embodiments, the nose region 656 of the blade 614 and the blade cover 630 are configured to interface such that the outer face and/or leading face of the blade 614 with the attached blade cover 630 have a smooth transition to adjacent regions without the blade cover 630. Typically, downhole bits experience the highest rate of wear and/or erosion in the nose 656 region, at least in part because of a high hydraulic fluid velocity of drilling fluid exiting a nozzle on the bit. Therefore, to reduce wear and erosion in these otherwise high-wear regions (especially near the exit of a nozzle), the blade cover 630 may only be applied to the portions of the blade 614 that are more susceptible to wear and/or erosion. In some embodiments, regions or zones of the blade 614 without the blade cover 630 may have hardfacing applied to a leading face, an outer face, a trailing face, or any combination thereof. This may help reduce costs.

A bit may be designed for specific downhole conditions. Accordingly, each bit may experience different levels of wear and/or erosion and/or wear and/or erosion in different portions of the blade 614. Therefore, it should be understood that, while the blade cover 630 shown in FIG. 6-2 covers the nose region 656 only, a blade cover 630 may cover any region. For example, the blade cover 630 may cover the cone 654, the shoulder 658, or the gage 660.

Similarly, as may be seen in FIG. 6-3, it should be understood that the blade cover 630 may cover multiple regions, such as the nose 656 and the cone 654 regions shown. It should be understood however, that the blade cover 630 may cover any combination of regions, such as the nose 656 and the shoulder 658 or the shoulder 658 and the gage 660. In some embodiments, the blade cover 630 may cover the nose 656, cone 654, and shoulder 658 regions. In some embodiments, the blade cover 630 may cover the nose 656, the shoulder 658, and the gage 660 regions. In some embodiments, the blade cover 630 may cover portions of regions. For example, the blade cover 630 may cover the nose 656 and a portion of the cone 654 or a portion of the shoulder 658. In this manner, the blade cover 630 may be tailored to a specific application, based on anticipated (or previously experienced) downhole conditions.

In some embodiments, the properties (e.g., material composition, particle size, particle distribution, binder) of the blade cover 630 may be different in different regions. For example, the nose 656 may have a blade cover 630 with a higher concentration of superhard materials compared to the shoulder 658. In some embodiments, the nose 656 may be formed from smaller particles, resulting in higher wear and/or erosion resistance. In some embodiments, the composition of the blade cover 630 may be tailored to each region of the blade. In some embodiments, different blade covers 630 may be used having different properties. In some embodiments, a single (e.g., integral) blade cover 630 may have different properties in different regions.

Figures 1, 7:
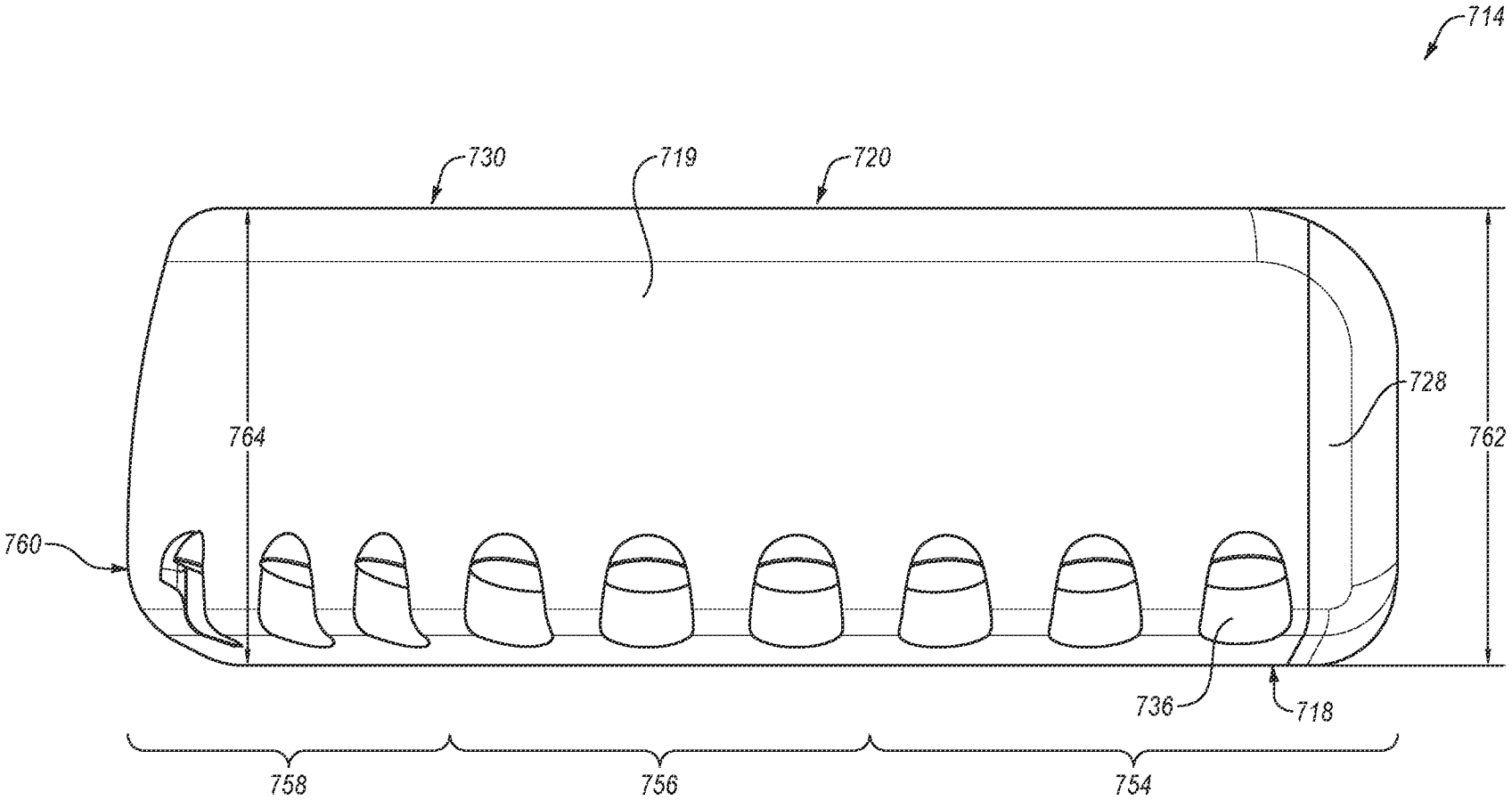
Figures 2, 7:
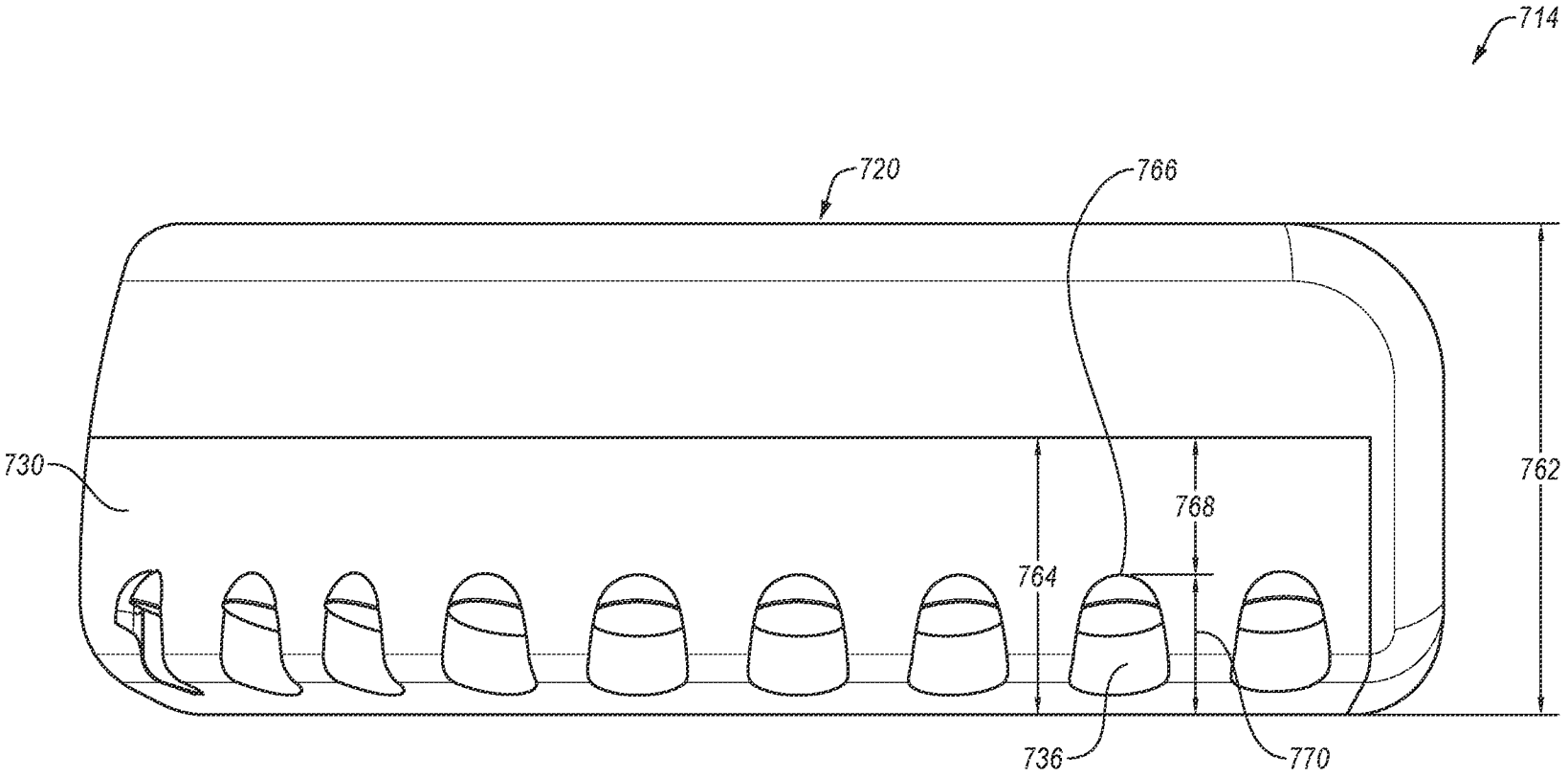
Figures 3, 7:
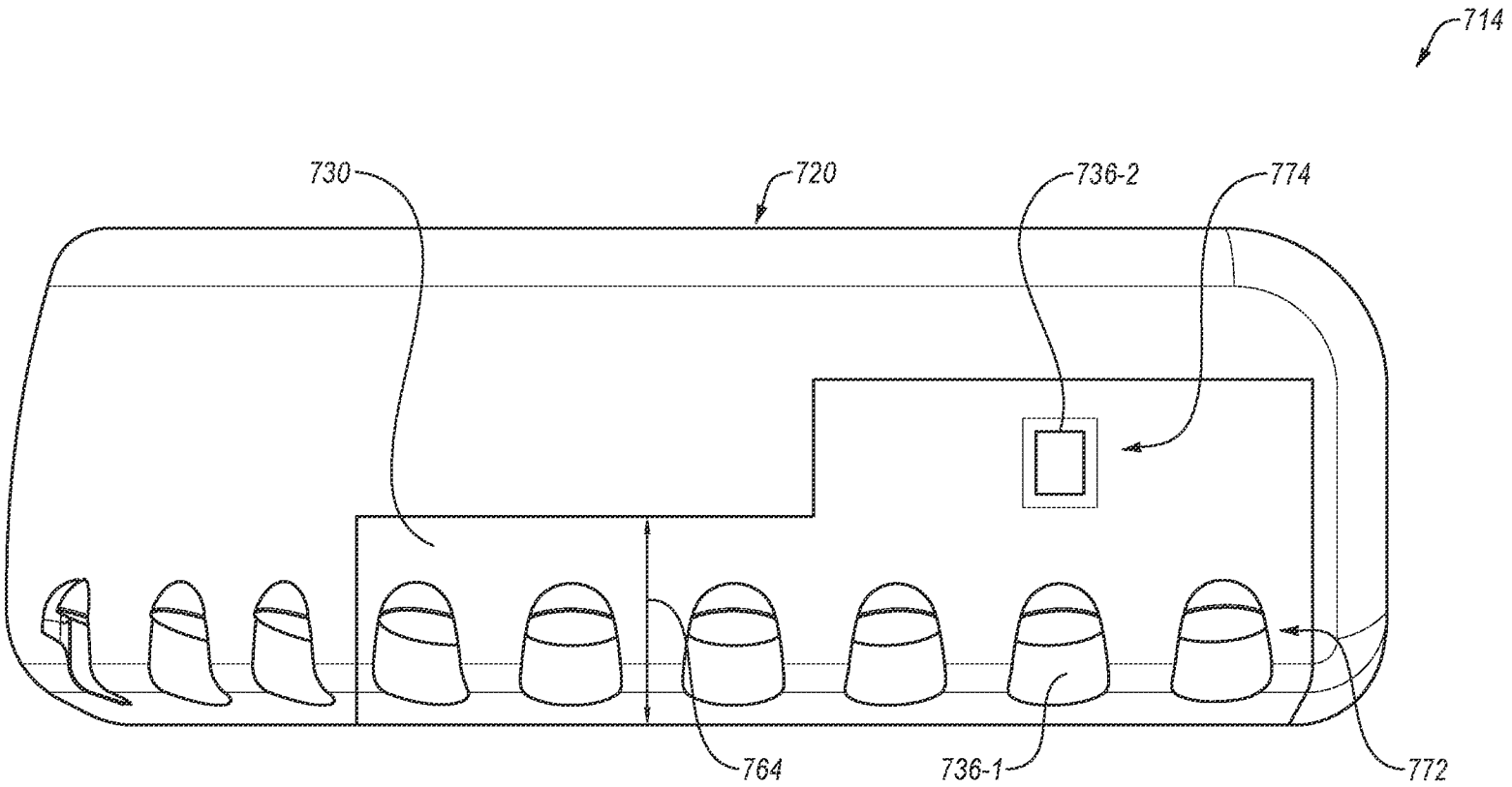

FIG. 7-1 through FIG. 7-3 are representations of an outer face 719 of a blade 714, according to at least one embodiment of the present disclosure. In the embodiment shown, a blade cover 730 has been installed on a blade body 728 along a length of the blade body 728 including the cone 754, the nose 756, the shoulder 758, and the gage 760. A plurality of cutter pockets 736 have been formed in the blade 714.

The blade 714 has a blade width 762. In the embodiment shown, the blade width 762 is constant from the cone 754 region to the gage 760 region. However, it should be understood that the blade width 762 may vary from the cone 754 to the gage region 760.

The blade cover 730 has a cover width 764. In the embodiment shown, the cover width 764 is the same as the blade width 762. In other words, the blade cover 730 shown extends from the leading face 718, across the entirety of the outer face 719, to the trailing face 720. In this manner, the blade 714 may not have any joint or other physical discontinuity along the entirety of the outer face 719. This may prevent or reduce erosion and/or wear on the blade 714 at the outer face 719.

In the embodiment shown in FIG. 7-2, the cover width 764 of the blade cover 730 may be less than the blade width 762. In some embodiments, the blade cover 730 may extend past a trailing edge 766 of the cutter pocket 736. In some embodiments, the trailing edge 766 of the cutter pocket 736 may be the edge of the cutter pocket that is closest to the trailing face 720 of the blade 714.

In some embodiments, the blade cover 730 may extend past the trailing edge 766 of the cutter pocket 736 with an edge distance 768. In some embodiments, the edge distance may be a pocket percentage of a cutter pocket length 770. In some embodiments, the pocket percentage may be in a range having an upper value, a lower value, or upper and lower values including any of 5%, 10%, 25%, 30%, 40%, 50%, 60%, 70%, 75%, 80%, 90%, 100%, or any value therebetween. For example, the pocket percentage may be greater than 25%. In another example, the pocket percentage may be less than 100%. In yet other examples, the pocket percentage may be any value in a range between 25% and 100%. In some embodiments, the pocket percentage may be greater than 100%. That is, the pocket percentage may be 125%, 150%, 200%, or 300% or more. In some embodiments, it may be critical that the pocket percentage is greater than 10% to provide wear and/or erosion protection to a cutting element installed in the cutter pocket 736.

In some embodiments, the blade cover 730 may extend past the trailing edge 766 of each cutter pocket 736 on the blade 714. In some embodiments, the blade cover 730 may extend past the trailing edge 766 only in the cone region, the nose region, the shoulder region, the gage region, or combinations thereof. In some embodiments, the edge distance 768 may be the same for each cutter pocket 736. In some embodiments, the edge distance 768 may be different for different cutter pockets 736. For example, the edge distance 768 may be greater for cutter pockets 736 in high-wear regions (e.g., the nose).

In some embodiments, the cover width 764 may be a cover percentage of the blade width 762. In some embodiments, the cover percentage may be in a range having an upper value, a lower value, or upper and lower values including any of 25%, 30%, 35%, 40%, 50%, 60%, 70%, 80%, 90%, 100%, or any value therebetween. For example, the cover percentage may be greater than 25%. In another example, the cover percentage may be less than 100%. In yet other examples, the cover percentage may be any value in a range between 25% and 100%. In some embodiments, it may be critical that the cover percentage is greater than 30% to provide wear and/or erosion protection to a cutting element installed on the cutter pocket 736.

In FIG. 7-3, the blade includes a first row 772 of first cutter pockets 736-1 and a second row 774 of second cutter pockets 736-2. As may be seen, the blade cover 730 may have a varying cover width 764. For example, in the embodiment shown, the blade cover 730 extends past the second cutter pocket 736-2 in the second row 774. The blade cover 730 may have a reduced cover width 764 after the second cutter pocket 736-2. In this manner, the blade cover 730 may be tailored to the specifications of the blade 714 to reduce erosion.

Figure 8:
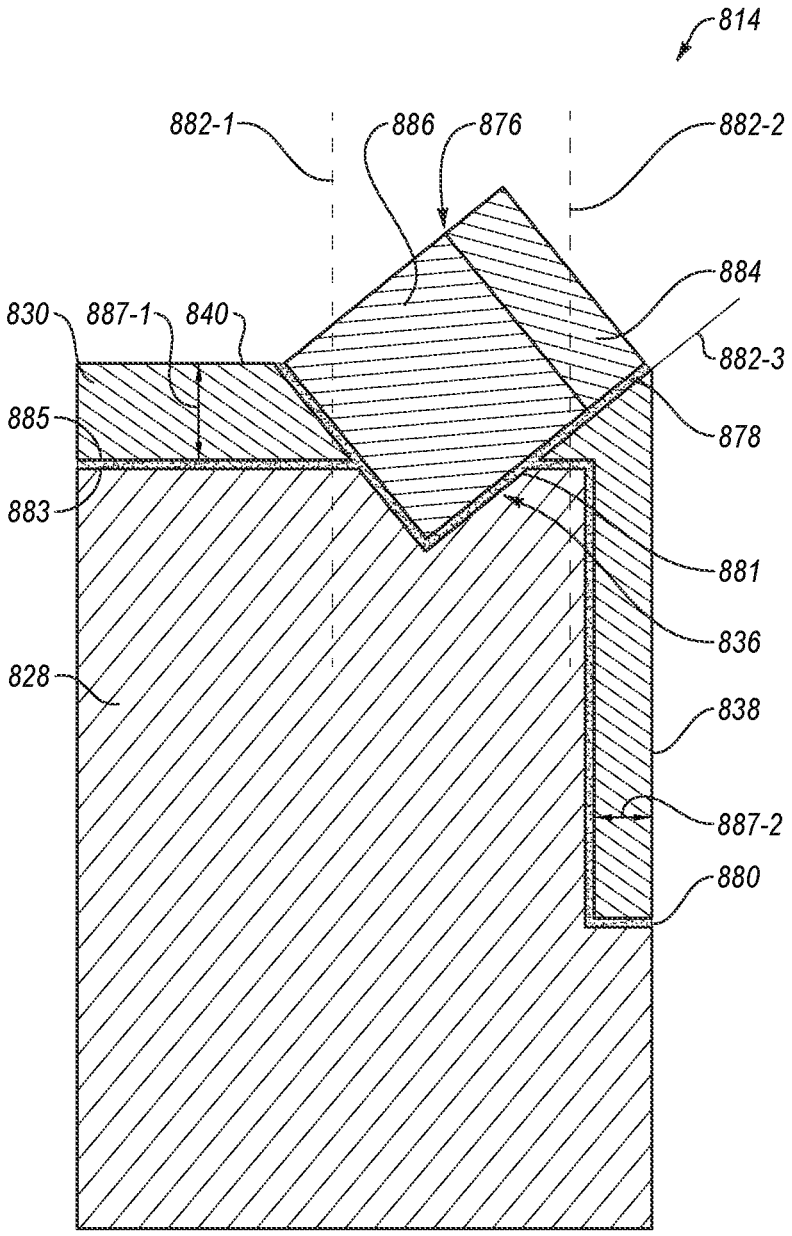
FIG. 8 is a representation of a blade, according to at least one embodiment of the present disclosure.

FIG. 8 is a representation of a cross-sectional view of a blade 814, according to at least one embodiment of the present disclosure. In the embodiment shown, a cutting element 876 is installed in a cutter pocket 836 which has been formed in the blade 814. In some embodiments, the cutting element 876 may be brazed in the cutter pocket 836 with a cutter braze 878. In some embodiments, the cutter braze 878 may include a metal or a metal alloy, such as aluminum alloys, copper alloys, brass, bronze, nickel alloys, silver alloys, any other metal alloy, and combinations thereof.

The blade 814 may include a blade cover 830 connected to a blade body 828. In the embodiment shown, the blade cover 830 is brazed to the blade body 828 with a cover braze 880. In some embodiments, the cover braze may include a metal or a metal alloy, such as aluminum alloys, copper alloys, brass, bronze, nickel alloys, silver alloys (e.g., AWS BAG 22, AWS BAG 24), any other metal alloy, and combinations thereof.

According to embodiments of the present disclosure, the cutting element 876 may include any cutting element. For example, the cutting element 876 may include an ultrahard (e.g., polycrystalline diamond (PCD)) layer 884 made from an ultrahard material. The ultrahard layer 884 may be attached to, formed on, or otherwise connected to a substrate 886. In some embodiments, the substrate 886 may be formed from tungsten carbide or other hard material.

As may be seen, the cutter pocket 836 is formed in the blade 814 such that both the blade cover 830 and the blade body 828 are exposed. For example, as discussed above, the cutter pocket 836 may be machined in the blade using ultrasonic grinding after the blade cover 830 is brazed to the blade body 828. In some embodiments, a profile 881 of the cutter pocket 836 may be smooth. For example, the profile 881 of the cutter pocket 836 may not include any ledges, bumps, or any other change in smoothness of the profile 881 at a transition between the blade cover 830 and the blade body 828.

In some embodiments, the cutter pocket 836 has a surface finish. In some embodiments, because the cutter pocket 836 is formed after the blade cover 830 is brazed to the blade body 828, the surface finish at the blade cover 830 may be the same as the surface finish at the blade body 828. In some embodiments, the surface finish may be in a range having an upper value, a lower value, or upper and lower values including any of less than 100 microns, less than 90 microns, less than 80 microns, less than 70 microns, less than 60 microns, less than 50 microns, less than 40 microns, less than 30 microns, less than 20 microns, less than 10 microns, less than 5 microns, or any value therebetween. In some embodiments, it may be critical that the surface finish is less than 60 microns to provide better bonding between the cutting element 876 and the blade 814.

In some embodiments, the blade cover 830 has a blade cover thickness (collectively 887). The blade cover thickness 887 may be the thickness of the blade cover 830 from an outer surface of the blade cover 830 to the inner surface of the blade cover 830, or from the outer surface of the blade cover 830 to the cover braze 880. In some embodiments, the blade cover thickness 887 may be in a range having an upper value, a lower value, or upper and lower values including any of 0.05 in. (1.27 mm), 0.10 in. (2.54 mm), 0.15 in. (3.81 mm), 0.20 in. (5.08 mm), 0.25 in. (6.35 mm), 0.30 in. (7.62 mm), 0.35 in. (8.89 mm), or any value therebetween. For example, the blade cover thickness 887 may be greater than 0.05 in. (1.27 mm). In another example, the blade cover thickness 887 may be less than 0.35 in. (8.89 mm). In yet other examples, the blade cover thickness 887 may be any value in a range between 0.05 in. (1.27 mm) and 0.35 in. (8.89 mm). In some embodiments, it may be critical that the blade cover thickness 887 is between 0.10 in (2.54 mm) and 0.30 in. (7.62 mm) to provide wear protection for the blade body 828 and structural stability for the blade cover 830. In some embodiments, the blade cover thickness 887 may be between 0.125 in. (3.175 mm) and 0.25 in. (6.35 mm).

In some embodiments, the cover outer face 840 of the blade cover 830 may have an outer face cover thickness 887-1. The cover leading face 838 may have a leading face cover thickness 887-2. In the embodiment shown in FIG. 8, the outer face cover thickness 887-1 is thicker than the leading face cover thickness 887-2. However, it should be understood that the outer face cover thickness 887-1 may be the same as the leading face cover thickness 887-2. Furthermore, the leading face cover thickness 887-2 may be greater than the outer face cover thickness 887-1. In some embodiments, the blade cover 830 may include a cover trailing face that covers a trailing face of the blade body 828. It should be understood that a trailing face cover thickness of the cover trailing face may be the same thickness as, or a different thickness than, the outer face cover thickness 887-1 and/or the leading face cover thickness 887-2. In some embodiments, the outer face cover thickness 887-1 may be greater than the leading face cover thickness 887-2 in a first zone of the blade 814 (e.g., nose, shoulder) yet less than the leading face cover thickness 887-2 in a second zone of the blade 814 (e.g., cone, gage).

The relative thicknesses outer face cover thickness 887-1, the leading face cover thickness 887-2, and/or the trailing face cover thickness may be dependent upon the wear characteristics of the blade 814. In some embodiments, a portion of the blade 814 that is subject to relatively higher wear may have a relatively thicker cover thickness 887 than a portion of the blade that is subject to relatively lower wear. For example, if a cover leading face 838 is located near a nozzle, then the leading face cover thickness 887-2 may be increased. In some examples, the cover thickness 887 may be increased at or near high-load areas of the blade 814, such as the nose. In some embodiments, the cover thickness 887 may decrease from the nose to the gage of the blade 814.

The blade body 828 includes a body profile 883 and the body cover 830 includes a cover profile 885. The body profile 883 includes the outer outline of the blade body 828, including any ridges, bumps, detents, protrusions, indentations, other physical features, or combinations thereof, of the blade body 828. The cover profile 885 includes the inner outline of the blade cover 830, including any ridges, bumps, detents, protrusions, indentations, other physical features, or combinations thereof, of the body cover 830. In some embodiments, the body profile 883 and the cover profile 885 may be complementary. In other words, for each feature present on the body profile 883, the cover profile 885 may include an inverse shape of similar size and in the same location. However, it should be understood that, while the cutter pocket 836 may include features in the body profile 883 and/or the cover profile 885, the body profile 883 and the cover profile 885 may not be complementary at the cutter pocket 836.

In some embodiments, the body profile 883 and the cover profile 885 may be complementary within the manufacturing tolerances of the blade body 828 and the blade cover 830. In other words, the blade body 828 and the blade cover 830 may have a design body profile 838 and cover profile 885, respectively. While manufacturing and/or forming (e.g., machining or milling) the blade body 828 and the blade cover 830, the body profile 883 and/or the cover profile 885 may deviate from the design profiles, based on the tolerances of the manufacturing processes. According to embodiments of the present disclosure, the manufactured body profile 883 may be complementary to the manufactured cover profile 885 if any differences between the profiles are within the respective manufacturing tolerances. In some embodiments, a brazing gap between the cover inner profile and the blade outer profile may be controlled within a range to provide high quality of brazing, thereby improving strength. In some embodiments, the brazing gap may be 0.001 in., 0.005 in., 0.010 in., 0.020, or any value therebetween. In some embodiments, the brazing gap may be 0.010 in. to accommodate the manufacturing tolerance of each mating surface and provide sufficient brazing strength.

In some embodiments, a first line 882-1 drawn through blade 814 may cross through or more elements of the blade 814. For example, the first line 882-1 may cross through one or more of the cutting element 876, the cutter braze 878, the blade cover 830, the cover braze 880, and the blade body 828. In some embodiments, the first line 882-1 may cross through these elements in order. In other words, the first line 882-1 may cross through, in order, the cutting element 876, the cutter braze 878, the blade cover 830, the cover braze 880, and the blade body 828. In some embodiments, the respective elements may be adjacent to each other. For example, the respective elements may not have any intervening material between adjacent elements. Thus, the cutting element 876 may be adjacent to the cutter braze 878, the cutter braze 878 may be adjacent to the blade cover 830, the blade cover may be adjacent to the cover braze 880, and the cover braze 880 may be adjacent to the blade body.

In some embodiments, the first line 882-1 may be parallel to the cover leading face 838. In some embodiments, the first line 882-1 may be transverse to the cover outer face 840. In some embodiments, the first line 882-1 may be perpendicular to the cover outer face 840. In some embodiments, the first line 882-1 may be parallel to a longitudinal axis of the bit (e.g., bit 310 of FIG. 3-1).

In some embodiments, a second line 882-2 drawing through the blade 814 may cross through one or more elements of the blade 814. Specifically, the second line 882-2 may cross through an ultrahard layer 884 of the cutting element 876, a substrate 886 of the cutting element 876, the cutter braze 878, the blade cover 830, the cover braze 880, and the blade body 828. In some embodiments, the second line 882-2 may cross through these elements in order. In other words, the second line 882-2 may cross through, in order, the ultrahard layer 884, the substrate 886, the cutter braze 878, the blade cover 830, the cover braze 880, and the blade body 828. In some embodiments, the respective elements may be adjacent to each other. For example, the respective elements may not have any intervening material between adjacent elements. Thus, the ultrahard layer 884 may be adjacent to the substrate 886, the substrate 886 may be adjacent to the cutter braze 878, the cutter braze 878 may be adjacent to the blade cover 830, the blade cover may be adjacent to the cover braze 880, and the cover braze 880 may be adjacent to the blade body. In some embodiments, the ultrahard layer 884 may be adjacent to the cutter braze 878.

In some embodiments, the second line 882-2 may be parallel to the cover leading face 838. In some embodiments, the second line 882-2 may be transverse to the cover outer face 840. In some embodiments, the second line 882-2 may be perpendicular to the cover outer face 840. In some embodiments, the second line 882-2 may be parallel to a longitudinal axis of the bit.

The structure described above with respect to the first line 882-1 and the second line 882-2 is a result of the separate manufacturing and assembly of the blade cover 830 to the blade body 828. Because the cutter pocket 836 is formed in both the blade cover 830 and the blade body 828, the cutting element 876 may contact both the blade cover 830 and the blade body 828. Furthermore, the cutting element 876 may be located over both the blade cover 830 and the blade body 828 simultaneously. This may help to provide additional retention for the cutting element 876 to the cutter pocket 836.

In some embodiments, a third line 882-3 may be drawn parallel to the cutting element 876. In some embodiments, the third line 882-3 may be drawn through the cutter braze 878. The third line 882-3 may be adjacent to both the cutter pocket 836 and the cutting element 876. In other words, on a first side of the third line 882-3 may be located the cutting element 876, and on a second side of the third line 882-3 may be the cutter pocket 836. In some embodiments, elements of the cutting element 876 may be simultaneously adjacent to the third line 882-3. For example, in some embodiments, the cutting element 876, the blade cover 830, and the blade body 828 may be simultaneously adjacent to the third line 882-3. In some embodiments, the ultrahard layer 834, the substrate 886, the blade cover 830, and the blade body 828 may be simultaneously adjacent to the third line 882-3. In some embodiments, the ultrahard layer 834, the substrate 886, the blade cover 830, the blade body 828, and the cover braze 880 may be simultaneously adjacent to the third line 882-3.

In some embodiments, the cutter braze 878 may contact different elements of the blade 814. For example, the cutter braze 878 may contact the cutting element 876, the blade cover 830, and the blade body 828. In some examples, the cutter braze 878 may contact the ultrahard layer 834, the substrate 886, the blade cover 830, and the blade body 828. In some examples, the cutter braze 878 may contact the ultrahard layer 834, the substrate 886, the blade cover 830, the blade body 828, and the cover braze 880. In some embodiments, a line may be drawn through the cutting element 876, the cutter braze 878, and the blade body 828 without contacting the blade cover 830 due to aligned and/or commonly formed cutter pockets through the blade cover 830 and into the blade body 828.

Figure 9:
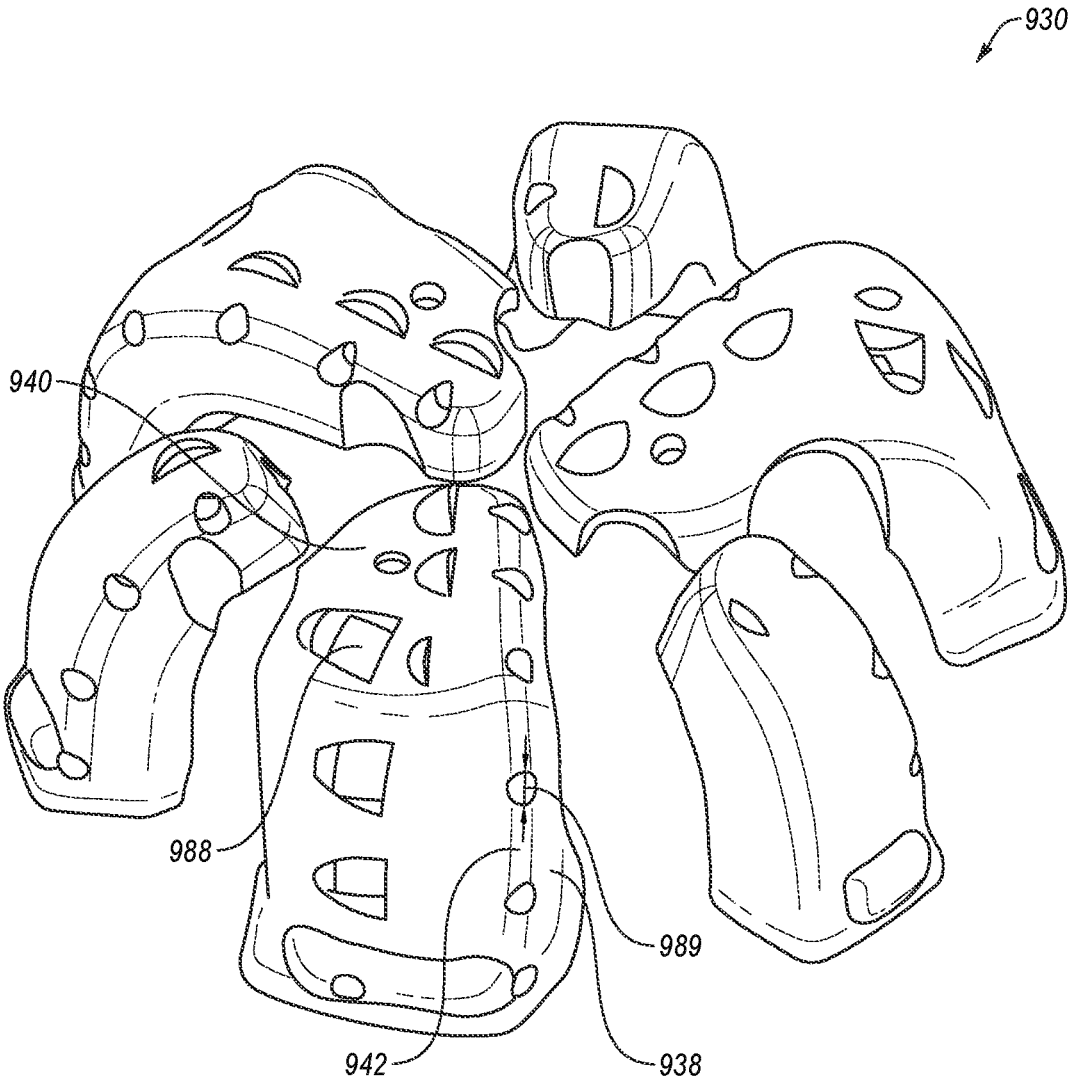
FIG. 9 is a representation of another blade, according to at least one embodiment of the present disclosure.

FIG. 9 is a representation of a blade cover 930 configured to connect to a blade body (e.g., blade body 428 of FIG. 4-1), according to at least one embodiment of the present disclosure. In the embodiment shown, the blade cover 930 includes a pilot recess 988 formed in the blade cover 930. In some embodiments, and as discussed further herein, manufacturing tolerances of the blade cover 930 may result in misalignment of a cover cutter pocket (e.g., cover cutter pocket 332 of FIG. 3-1) with a body cutter pocket (e.g., body cutter pocket 334 of FIG. 3-1). Furthermore, ultrasonic grinding of the blade cover 930 to form a cutter pocket (e.g., cutter pocket 336 of FIG. 3-2) may be time and/or resource intensive.

To reduce the amount of post-assembly processing, a pilot recess 988 may be formed in the blade cover 930 during pre-sintering. In some embodiments, the pilot recess 988 is a recess in the blade cover 930 having a nonzero thickness of the blade cover 930. For example, the pilot recess 988 may be section of the blade cover 930 that has a recess thickness that is less than the cover thickness (e.g., cover thickness 877 of FIG. 8). In some embodiments, the pilot recess 988 may be a pilot hole. That is, the pilot recess 988 may extend through an entirety of the blade cover 988.

The pilot recess 988 may be small enough that its outer limits may be within the known manufacturing tolerances of the sintering process. In this manner, the amount of material to be removed to form the cutter pocket after the blade cover 930 is brazed to the blade body may be reduced. This may reduce the post-assembly machining time and resources used. As may be seen in a comparison between the blade cover 930 of FIG. 9 and the blade cover 330 of FIG. 3-1, the pilot recess 988 is smaller than the cover cutter pocket 332. Thus, the chance of a misalignment is reduced. After the blade cover 930 is attached to the blade body, the cutter pockets may be formed in the blade cover and the blade body (such as by ultrasonic grinding), thereby forming the final blade as seen in FIG. 3-2.

In some embodiments, the pilot recess 988 may have recess rim dimension 989 that is a recess reduction less than a final rim dimension of the final cutter pocket. In some embodiments, the recess reduction may be in a range having an upper value, a lower value, or upper and lower values including any of 0.005 in. (0.127 mm), 0.010 in. (0.254 mm), in. (0.381 mm), 0.020 in. (0.508 mm), 0.025 in. (0.635 mm), 0.030 in. (0.762 mm), in. (0.889 mm), 0.040 in. (1.02 mm), 0.045 in. (1.14 mm), 0.05 in. (1.27 mm), or any value therebetween. For example, the recess reduction may be greater than 0.005 in. (0.127 mm). In another example, the recess reduction may be less than 0.05 in. (1.27 mm). In yet other examples, the recess reduction may be any value in a range between 0.005 in. (0.127 mm) and 0.05 in. (1.27 mm). In some embodiments, it may be critical that the recess reduction is less than 0.040 in. (1.02 mm) to reduce misalignment of the final cutter pocket.

In some embodiments, the recess rim dimension 989 may reduce from the outer surface of the blade cover 930 toward the inner surface of the blade cover. In some embodiments, the recess rim dimension 989 may remain the same throughout a depth of the pilot recess 988. In some embodiments, the recess reduction may remain constant throughout a depth of the pilot recess 988. In other words, the recess rim dimension 989 may be offset from the final cutter pocket by a constant recess reduction.

In some embodiments, the pilot recess 988 may be located anywhere on the blade cover 930. For example, the pilot recess 988 may be located at the cover leading face 938. In some examples, the pilot recess 988 may be located at the cover outer face 940. In some embodiments, the pilot recess 988 may be located at the cover leading edge 942. In some embodiments, the blade cover 930 may include any number of pilot recesses 988 located anywhere on the blade cover 930. For example, the blade cover 930 may include pilot recesses 988 on the cover leading face 938 and the cover outer face 940. In some embodiments, the blade cover 930 may include pilot recesses 988 on the cover leading edge 942 and the cover outer face 940. In some embodiments, the blade cover 930 may include pilot recesses 988 on the cover leading face 938 and the cover leading edge 942. In some embodiments, the blade cover 930 may include pilot recesses 988 on the cover leading face 938, the cover leading edge 942, and the cover outer face 940.

Figure 10:
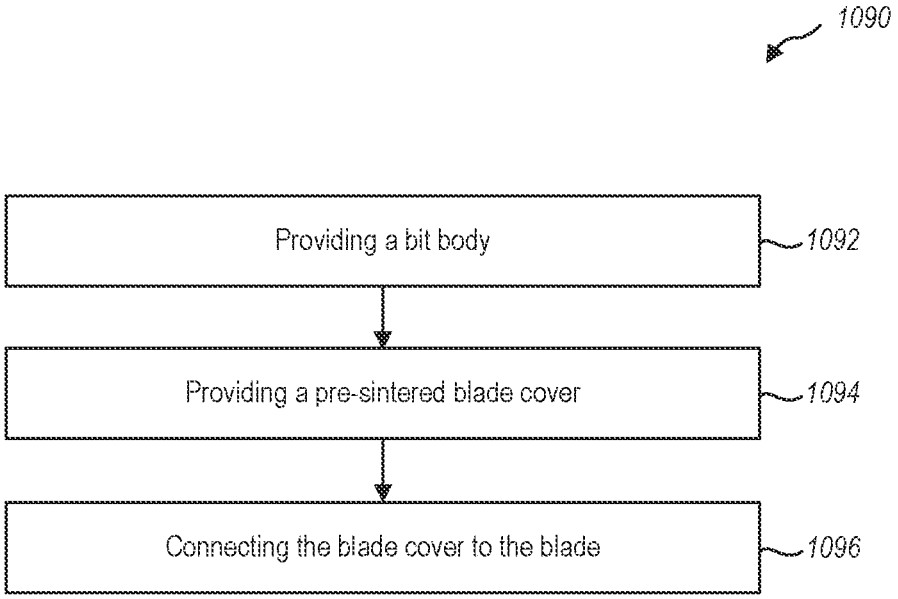
FIG. 10 is a representation of a method of forming a bit, according to at least one embodiment of the present disclosure.

FIG. 10 is a representation of a method 1090 of forming a bit, according to at least one embodiment of the present disclosure. In some embodiments, and without limiting the present disclosure, the acts of the method 1090 may be represented in a successive viewing of FIGS. 3-1 and 3-2, and a successive viewing of FIG. 4-1 through FIG. 4-3. The method 1090 may include providing a bit body at 1092. The bit body may include a blade, and the blade may include a body leading face and a body trailing face. The method 1090 may further include providing a pre-sintered blade cover at 1094. The pre-sintered blade cover may include a cover leading face and a cover outer face. In some embodiments, providing the pre-sintered blade cover may include pre-sintering the blade cover. For example, pre-sintering the blade cover may include additively manufacturing the blade cover, casting the blade cover, or any other mechanism for pre-sintering the blade cover.

In some embodiments, providing the bit body may include forming (e.g., through machining or casting) the blade with a blade profile. Providing the pre-sintered blade cover may include providing the pre-sintered blade cover with an inner blade cover profile. The blade profile may be complementary to the blade cover profile. In this manner, when the blade cover is connected to the blade, the blade cover may be easily and readily connected to the blade without further machining or working of the blade body.

The method 1090 may further include connecting the blade cover to the blade at 1096. Connecting the blade cover to the blade may cause the cover leading face to cover at least part of the blade leading face and the cover outer face to cover at least part of the blade outer face. In some embodiments, the blade may include a blade trailing face and the blade cover may include a cover trailing face and connecting the blade cover to the blade may cause the cover trailing face to cover at least part of the blade trailing face. In some embodiments, connecting the blade cover to the blade may include brazing the blade cover to the blade.

In some embodiments, connecting the blade cover to the blade may include permanently connecting the blade cover to the blade. For example, once the blade cover is connected to the blade, the blade cover may only be removed from the blade by breaking or otherwise destroying a portion of the blade cover or the blade. In some embodiments, the blade cover may be removably connected to the blade, such as by heating the blade cover and the blade up to the melting point of the braze material and removing the blade cover when the braze material has melted.

Figure 11:
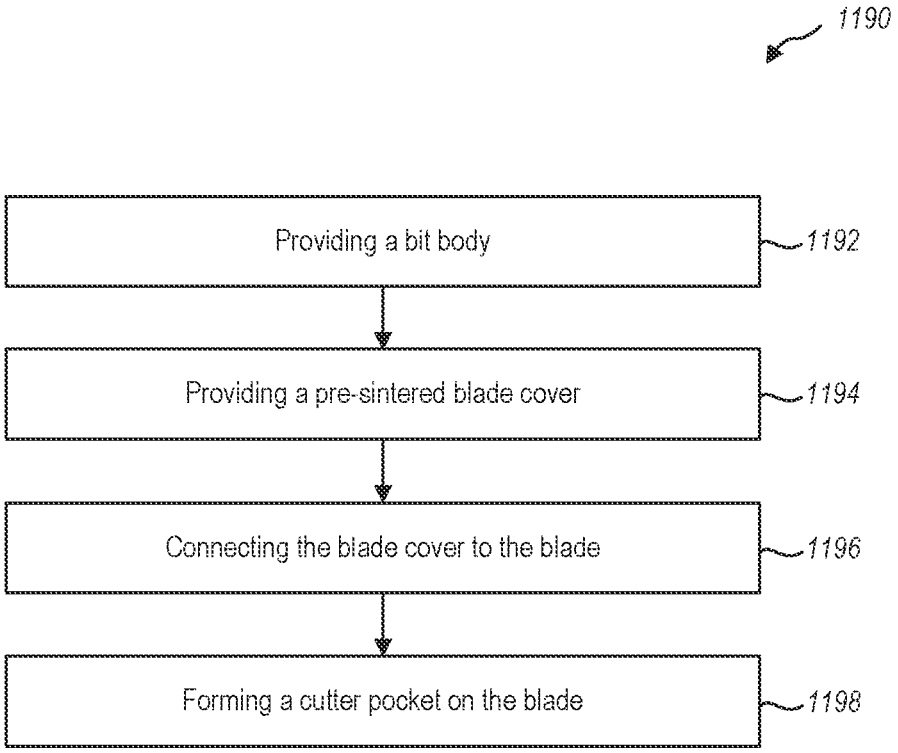
FIG. 11 is a representation of another method of forming a bit, according to at least one embodiment of the present disclosure.

FIG. 11 is a representation of a method 1190 for forming a bit, according to at least one embodiment of the present disclosure. In some embodiments, and without limiting the present disclosure, the acts of the method 1190 may be represented in a successive viewing of FIGS. 3-1 and 3-2, and a successive viewing of FIG. 4-1 through FIG. 4-3. The method 1190 may include providing a bit body at 1192. The bit body may include a blade, and the blade may include a body leading face and a body trailing face. The method 1190 may further include providing a pre-sintered blade cover at 1194. The pre-sintered blade cover may include a cover leading face and a cover outer face. The method 1190 may further include connecting the blade cover to the blade at 1196. Connecting the blade cover to the blade may cause the cover leading face to cover at least part of the blade leading face and the cover outer face to cover at least part of the blade outer face.

In some embodiments, the method 1190 may further include forming a cutter pocket on the blade after the blade cover is connected to the blade at 1198. Forming the cutter pocket on the blade may include removing at least a portion of the blade cover. In some embodiments, forming the cutter pocket may include removing at least a portion of the blade cover and at least a portion of the blade body. In some embodiments, forming the cutter pocket may include removing material through ultrasonic grinding.

In some embodiments, providing the blade cover may include forming the blade cover with one or more cover cutter pockets. For example, the blade cover may be additively manufactured into a shape including one or more cover cutter pockets. In some examples, the blade cover may be cast with a shape including one or more cover cutter pockets. In some embodiments, the blade cover may be formed, and a portion of the blade cover removed (e.g., through machining or ultrasonic grinding) to form the cover cutter pockets. In some embodiments, the blade cover may be formed with a pilot recess in the general location of the final cutter pocket. The pilot recess may be sized such that, within manufacturing tolerances, the pilot recess may not extend beyond the edges of the final cutter pocket.

In some embodiments, providing the bit body may include providing a blade that includes one or more blade cutter pockets. In some embodiments, the one or more blade cutter pockets may be machined into the blade after manufacturing. In some embodiments, the one or more blade cutter pockets may be cast into the blade while casting the bit body.

In some embodiments, forming the cutter pocket may include aligning the blade cutter pocket with the cover cutter pocket while connecting the blade cover to the blade. In some embodiments, forming the cutter pocket may include final machining of the cutter pocket to a final cutter pocket dimension.

The embodiments of the blade cover have been primarily described with reference to wellbore drilling operations; the blade cover described herein may be used in applications other than the drilling of a wellbore. In other embodiments, blade covers according to the present disclosure may be used outside a wellbore or other downhole environment used for the exploration or production of natural resources. For instance, blade covers of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A pre-sintered blade cover for connecting to a blade body of a blade of a downhole tool, the blade body including a body leading face, a body outer face, a first keying feature, and a cutter pocket, the pre-sintered blade cover comprising:

a cover leading face configured to connect to the body leading face of the blade of the downhole tool;

a cover outer face configured to connect to the body outer face of the blade, wherein the cover outer face extends past a trailing edge of the cutter pocket of the blade, and wherein the cover leading face and the cover outer face are integrally formed; and a second keying feature complementary to the first keying feature of the blade body, wherein the first keying feature and the second keying feature are configured to align the pre-sintered blade cover on the blade body.

2. The pre-sintered blade cover of claim 1, wherein the cover leading face and the cover outer face surround at least a plurality of cutter pockets.

3. The pre-sintered blade cover of claim 1, wherein a cover leading edge between the cover leading face and the cover outer face is seamless.

4. The pre-sintered blade cover of claim 1, wherein the cover leading face and the cover outer face are configured to connect to the blade with a braze.

5. The pre-sintered blade cover of claim 1, comprising a cover cutter pocket configured to align with the cutter pocket on the blade.

6. The pre-sintered blade cover of claim 1, comprising a cover trailing face configured to connect to a trailing face of the blade.

7. The pre-sintered blade cover of claim 1, wherein the cover leading face and the cover outer face are configured to cover a nose of the blade.

8. The pre-sintered blade cover of claim 1, wherein at least one of the cover leading face or the cover outer face comprises a pilot recess for forming the cutter pocket.

9. A downhole tool, comprising:

a body;

a blade connected to the body, the blade including a first keying feature; and a blade cover brazed to the blade with a cover braze, the blade cover seamlessly extending from a cover leading face to a cover outer face, and the blade cover comprising a second keying feature complementary to the first keying feature of the blade, wherein the first keying feature and the second keying feature are configured to align the blade cover on the blade.

10. The downhole tool of claim 9, further comprising:

a cutting element connected to the blade, the cutting element comprising an ultrahard material connected to a substrate.

11. The downhole tool of claim 10, wherein the cutting element is brazed to the blade cover and to the blade by a cutter braze.

12. The downhole tool of claim 9, wherein an inner surface of the blade cover is engaged with an outer surface of the blade and the cover outer face of the blade cover does not include a cover cutter pocket.

13. A method of forming a downhole tool, comprising:

providing a body, the body comprising a blade, the blade comprising a first kaying feature, body leading face, and body outer face;

providing a pre-sintered blade cover, the pre-sintered blade cover comprising a second keying feature, a cover leading face, and a cover outer face, wherein the second keying feature is complementary to the first keying feature of the blade, and wherein the first keying feature and the second keying feature are configured to align the pre-sintered blade cover on the blade;

connecting the pre-sintered blade cover to the blade such that the first keying feature is engaged with the second keying feature and the cover outer face covers at least part of the body outer face; and forming a cutter pocket in the pre-sintered blade cover and the blade after connecting the pre-sintered blade cover to the blade by removing at least a portion of the pre-sintered blade cover and at least a portion of the blade.

14. The method of claim 13, wherein providing the pre-sintered blade cover comprises providing the pre-sintered blade cover with a pilot recess, and wherein forming the cutter pocket comprises forming the cutter pocket at the pilot recess.

15. The method of claim 13, wherein connecting the pre-sintered blade cover to the blade comprises brazing the pre-sintered blade cover to the blade.

16. The method of claim 13, wherein providing the pre-sintered blade cover comprises additively manufacturing the pre-sintered blade cover.

17. The method of claim 13, wherein providing the body comprises forming the blade with a blade profile, the blade profile being complementary to a cover profile of the pre-sintered blade cover.

18. The method of claim 13, further comprising installing a cutter into the cutter pocket.

* * * * *